US008096937B2

(12) United States Patent
Miller, III

(10) Patent No.: US 8,096,937 B2
(45) Date of Patent: Jan. 17, 2012

(54) ADAPTIVE CANCELLATION SYSTEM FOR IMPLANTABLE HEARING INSTRUMENTS

(75) Inventor: Scott Allan Miller, III, Lafayette, CO (US)

(73) Assignee: Otologics, LLC, Boulder, CO (US)

( * ) Notice: Subject to any disclaimer, the term of this patent is extended or adjusted under 35 U.S.C. 154(b) by 1448 days.

(21) Appl. No.: 11/565,014

(22) Filed: Nov. 30, 2006

(65) Prior Publication Data

US 2008/0132750 A1 Jun. 5, 2008

Related U.S. Application Data

(63) Continuation-in-part of application No. 11/330,788, filed on Jan. 11, 2006, now Pat. No. 7,775,964.

(60) Provisional application No. 60/643,074, filed on Jan. 11, 2005, provisional application No. 60/740,710, filed on Nov. 30, 2005.

(51) Int. Cl.
*H04R 25/00* (2006.01)

(52) U.S. Cl. ..... 600/25

(58) Field of Classification Search ..... 600/25; 607/55–57; 381/94, 71, 83, 93, 60, 23.1
See application file for complete search history.

(56) References Cited

U.S. PATENT DOCUMENTS

| | | | | |
|---|---|---|---|---|
| 4,443,666 | A | 4/1984 | Cote | 318/113 |
| 4,450,930 | A | 5/1984 | Killion | 181/129 |
| 4,504,703 | A | 3/1985 | Schneiter et al. | 181/163 |
| 4,532,930 | A | 8/1985 | Crosby et al. | 128/419 |
| 4,606,329 | A | 8/1986 | Hough | 128/1 |
| 4,607,383 | A | 8/1986 | Ingalls | 381/113 |
| 4,621,171 | A | 11/1986 | Wada et al. | 381/113 |
| 4,774,933 | A | 10/1988 | Hough et al. | 600/25 |
| 4,815,560 | A | 3/1989 | Madaffari | 181/129 |
| 4,837,833 | A | 6/1989 | Madaffari | 181/129 |
| RE33,170 | E | 2/1990 | Byers | 128/419 |
| 4,932,405 | A | 6/1990 | Peeters et al. | 128/419 |
| 4,936,305 | A | 6/1990 | Ashtiani et al. | 128/420.6 |
| 5,001,763 | A | 3/1991 | Moseley | |

(Continued)

FOREIGN PATENT DOCUMENTS

EP 1 052 881 A2 11/2000

(Continued)

OTHER PUBLICATIONS

Zenner H.P. et al.; "Totally implantable hearing device for sensorineural hearing loss", Lancet The, Lancet Limited, vol. 352, No. 9142, p. 1751, Nov. 28, 1998.

*Primary Examiner* — Charles A Marmor, II
*Assistant Examiner* — Christine Hopkins
(74) *Attorney, Agent, or Firm* — Marsh Fischmann & Breyfogle LLP

(57) ABSTRACT

The invention is directed to an implanted microphone having reduced sensitivity to vibration. In this regard, the microphone differentiates between the desirable and undesirable vibration by utilizing at least one motion sensor to produce a motion signal when an implanted microphone is in motion. This motion signal is used to yield a microphone output signal that is less vibration sensitive. In a first arrangement, the motion signal may be processed with an output of the implantable microphone transducer to provide an audio signal that is less vibration-sensitive than the microphone output alone. Specifically, the motion signal may be scaled to match the motion component of the microphone output such that upon removal of the motion signal from the microphone output, the remaining signal is an acoustic signal.

19 Claims, 11 Drawing Sheets

U.S. PATENT DOCUMENTS 5,015,224 A 5/1991 Maniglia ..... 600/25
5,105,811 A 4/1992 Kuzma ..... 128/420.6
5,163,957 A 11/1992 Sade et al. ..... 623/10
5,176,620 A 1/1993 Gilman ..... 600/25
5,277,694 A 1/1994 Leysieffer et al. ..... 600/25
5,363,452 A 11/1994 Anderson ..... 381/170
5,402,496 A 3/1995 Soli ..... 381/94.2
5,411,467 A 5/1995 Hortmann et al. ..... 600/25
5,456,654 A 10/1995 Ball ..... 600/25
5,475,759 A 12/1995 Engebretson ..... 381/318
5,500,902 A 3/1996 Stockham, Jr. et al. ..... 381/320
5,554,096 A 9/1996 Ball ..... 600/25
5,558,618 A 9/1996 Maniglia ..... 600/25
5,624,376 A 4/1997 Ball et al. ..... 600/25
5,680,467 A 10/1997 Hansen ..... 381/314
5,702,431 A 12/1997 Wang et al. ..... 607/61
5,749,912 A 5/1998 Zhang et al. ..... 607/57
5,754,662 A 5/1998 Jolly et al.
5,762,583 A 6/1998 Adams et al. ..... 600/25
5,795,287 A 8/1998 Ball et al. ..... 600/25
5,800,336 A 9/1998 Ball et al. ..... 600/25
5,814,095 A 9/1998 Muller et al. ..... 607/57
5,842,967 A 12/1998 Kroll ..... 600/25
5,848,171 A 12/1998 Stockham, Jr. et al. ..... 381/ 310
5,857,958 A 1/1999 Ball et al. ..... 600/25
5,859,916 A 1/1999 Ball et al. ..... 381/326
5,881,158 A 3/1999 Lesinski et al. ..... 381/174
5,888,187 A 3/1999 Jaeger et al. ..... 600/25
5,897,486 A 4/1999 Ball et al. ..... 600/25
5,906,635 A 5/1999 Maniglia ..... 607/57
5,912,977 A 6/1999 Gottschalk-Schoenig ... 381/321
5,913,815 A 6/1999 Ball et al. ..... 600/25
5,951,601 A 9/1999 Lesinski et al. ..... 623/10
6,031,922 A 2/2000 Tibbetts
6,044,162 A 3/2000 Mead et al. ..... 381/312
6,072,884 A 6/2000 Kates ..... 381/318
6,072,885 A 6/2000 Stockham, Jr. et al. ..... 381/321
6,097,823 A 8/2000 Kuo ..... 381/312
6,104,822 A 8/2000 Melanson et al. ..... 381/320
6,108,431 A 8/2000 Bachler ..... 381/312
6,128,392 A 10/2000 Leysieffer et al. ..... 381/318
6,134,329 A 10/2000 Gao et al. ..... 381/60
6,151,400 A 11/2000 Seligman ..... 381/317
6,163,287 A 12/2000 Huang ..... 341/143
6,173,063 B1 1/2001 Melanson ..... 381/318
6,198,971 B1 3/2001 Leysieffer ..... 607/55
6,330,339 B1 12/2001 Ishige et al. ..... 381/312
6,381,336 B1 4/2002 Lesinski et al. ..... 381/326
6,422,991 B1 7/2002 Jaeger ..... 600/25
6,626,822 B1 9/2003 Jaeger ..... 600/25
6,688,169 B2 2/2004 Choe et al. ..... 73/170.13
6,707,920 B2 3/2004 Miller ..... 381/326
6,736,771 B2 5/2004 Sokolich et al.
6,807,445 B2 10/2004 Baumann ..... 607/57
7,024,011 B1 4/2006 Hamacher et al.
7,214,179 B2 5/2007 Miller, III et al.

FOREIGN PATENT DOCUMENTS

JP 2004048207 A 2/2004
WO 2006037156 A1 4/2006
WO 2006076531 A2 7/2006

ADAPTIVE CANCELLATION SYSTEM FOR IMPLANTABLE HEARING INSTRUMENTS

RELATED APPLICATION

This application is a continuation-in-part application of U.S. patent application Ser. No. 11/330,788, filed on Jan. 11, 2006, entitled "ACTIVE VIBRATION ATTENUATION FOR IMPLANTABLE MICROPHONE", and issued as U.S. Pat. No. 7,775,964, on Aug. 17, 2010, which claims priority to U.S. Provisional Application Ser. No. 60/643,074, filed on Jan. 11, 2005, entitled "ACTIVE VIBRATION ATTENUATION FOR IMPLANTABLE MICROPHONE", and to U.S. Provisional Application Ser. No. 60/740,710, filed on Nov. 30, 2005, entitled "ACTIVE VIBRATION ATTENUATION FOR IMPLANTABLE MICROPHONE".

FIELD OF THE INVENTION

The present invention relates to implanted hearing instruments, and more particularly, to the reduction of undesired signals from an output of an implanted microphone.

BACKGROUND OF THE INVENTION

In the class of hearing aid systems generally referred to as implantable hearing instruments, some or all of various hearing augmentation componentry is positioned subcutaneously on, within, or proximate to a patient's skull, typically at locations proximate the mastoid process. In this regard, implantable hearing instruments may be generally divided into two sub-classes, namely semi-implantable and fully implantable. In a semi-implantable hearing instrument, one or more components such as a microphone, signal processor, and transmitter may be externally located to receive, process, and inductively transmit an audio signal to implanted components such as a transducer. In a fully implantable hearing instrument, typically all of the components, e.g., the microphone, signal processor, and transducer, are located subcutaneously. In either arrangement, an implantable transducer is utilized to stimulate a component of the patient's auditory system (e.g., ossicles and/or the cochlea).

By way of example, one type of implantable transducer includes an electromechanical transducer having a magnetic coil that drives a vibratory actuator. The actuator is positioned to interface with and stimulate the ossicular chain of the patient via physical engagement. (See e.g., U.S. Pat. No. 5,702,342). In this regard, one or more bones of the ossicular chain are made to mechanically vibrate, which causes the ossicular chain to stimulate the cochlea through its natural input, the so-called oval window.

As may be appreciated, a hearing instrument that proposes to utilize an implanted microphone will require that the microphone be positioned at a location that facilitates the receipt of acoustic signals. For such purposes, an implantable microphone may be positioned (e.g., in a surgical procedure) between a patient's skull and skin, for example, at a location rearward and upward of a patient's ear (e.g., in the mastoid region).

For a wearer a hearing instrument including an implanted microphone (e.g., middle ear transducer or cochlear implant stimulation systems), the skin and tissue covering the microphone diaphragm may increase the vibration sensitivity of the instrument to the point where body sounds (e.g., chewing) and the wearer's own voice, conveyed via bone conduction, may saturate internal amplifier stages and thus lead to distortion. Also, in systems employing a middle ear stimulation transducer, the system may produce feedback by picking up and amplifying vibration caused by the stimulation transducer.

Certain proposed methods intended to mitigate vibration sensitivity may potentially also have an undesired effect on sensitivity to airborne sound as conducted through the skin. It is therefore desirable to have a means of reducing system response to vibration (e.g., caused by biological sources and/or feedback), without affecting sound sensitivity. It is also desired not to introduce excessive noise during the process of reducing the system response to vibration. These are the goals of the present invention.

SUMMARY OF THE INVENTION

In order to achieve this goal, it is necessary to differentiate between desirable signals, caused by outside sound, of the skin moving relative to an inertial (non accelerating) microphone implant housing, and undesirable signals, caused by bone vibration, of an implant housing and skin being accelerated by motion of the underlying bone, which will result in the inertia of the overlying skin exerting a force on the microphone diaphragm.

Differentiation between the desirable and undesirable signals may be at least partially achieved by utilizing one or more one-motion sensors to produce a motion signal(s) when an implanted microphone is in motion. Such a sensor may be, without limitation, an acceleration sensor and/or a velocity sensor. In any case, the motion signal is indicative movement of the implanted microphone diaphragm. In turn, this motion signal is used to yield a microphone output signal that is less vibration sensitive. The motion sensor(s) may be interconnected to an implantable support member for co-movement therewith. For example, such support member may be a part of an implantable microphone or part of an implantable capsule to which the implantable microphone is mounted.

The output of the motion sensor (i.e., motion signal) may be processed with an output of the implantable microphone (i.e., microphone signal) to provide an audio signal that is less vibration-sensitive than the microphone signal alone. For example, the motion signal may be appropriately scaled, phase shifted and/or frequency-shaped to match a difference in frequency response between the motion signal and the microphone signal, then subtracted from the microphone signal to yield a net, improved audio signal employable for driving a middle ear transducer, an inner ear transducer and/or a cochlear implant stimulation system.

In order to scale, frequency-shape and/or phase shift the motion signal, a variety of signal processing/filtering methods may be utilized. Mechanical feedback from an implanted transducer and other undesired signals, for example, those caused by biological sources, may be determined or estimated to adjust the phase/scale of the motion signal. Such determined and/or estimated signals may be utilized to generate an audio signal having a reduced response to the feedback and/or undesired signals. For instance, mechanical feedback may be determined by injecting a known signal into the system and measuring a feedback response at the motion sensor and microphone. By comparing the input signal and the feedback responses a maximum gain for a transfer function of the system may be determined. Such signals may be injected to the system at the factory to determine factory settings. Further such signals may be injected after implant, e.g., upon activation of the hearing instrument. In any case, by measuring the feedback response of the motion sensor and removing the corresponding motion signal from the microphone signal, the effects of such feedback may be reduced or substantially eliminated from the resulting net output (i.e., audio signal).

A filter may be utilized to represent the transfer function of the system. The filter may be operative to scale the magnitude and phase of the motion signal such that it may be made to substantially match the microphone signal for common sources of motion. Accordingly, by removing a 'filtered' motion signal from a microphone signal, the effects of noise associated with motion (e.g., caused by acceleration, vibration etc) may be substantially reduced. Further, by generating a filter operative to manipulate the motion signal to substantially match the microphone signal for mechanical feedback (e.g., caused by a known inserted signal), the filter may also be operative to manipulate the motion signal generated in response to other undesired signals such as biological noise.

One method for generating a filter or system model to match the output signal of a motion sensor to the output signal of a microphone includes inserting a known signal into an implanted hearing device in order to actuate an auditory stimulation mechanism of the implanted hearing device. This may entail initiating the operation of an actuator/transducer. Operation of the auditory stimulation mechanism may generate vibrations that may be transmitted back to an implanted microphone via a tissue path (e.g., bone and/or soft tissue). These vibrations or 'mechanical feedback' are represented in the output signal of the implanted microphone. Likewise, a motion sensor also receives the vibrations and generates an output response (i.e., motion signal). The output responses of the implanted microphone and motion sensor are then sampled to generate a system model that is operative to match the motion signal to the microphone signal. Once such a system model is generated, the system model may be implemented for use in subsequent operation of the implanted hearing device. That is, the matched response of the motion sensor (i.e., filtered motion signal) may be removed from the output response of the implanted microphone to produce a net output response having reduced response to undesired signals (e.g., noise).

In one arrangement, the system model is generated using the ratios of the microphone signal and motion signal over a desired frequency range. For instance, a plurality of the ratios of the signals may be determined over a desired frequency range. These ratios may then be utilized to create a mathematical model for adjusting the motion signal to match the microphone signal for a desired frequency range. For instance, a mathematical function may be fit to the ratios of the signals over a desired frequency range and this function may be implemented as a filter (e.g., a digital filter). The order of such a mathematical function may be selected to provide a desired degree of correlation between the signals. In any case, use of a second order or greater function may allow for non-linear adjustment of the motion signal based on frequency. That is, the motion signal may receive different scaling, frequency shaping and/or phase shifting at different frequencies. It will be appreciated that other methods may be utilized to model the response of the motion sensor to the response of the microphone. Accordingly, such additional methods for modeling the transfer function of the system are also considered within the scope of the present invention. In any case, the combination of a filter for filtering the motion signal and the subsequent subtraction of that filtered motion signal from the microphone signal can be termed a cancellation filter. Accordingly, the output of the cancellation filter is an estimate of the microphone acoustic response (i.e., with noise removed). Use of a fixed cancellation filter works well provided that the transfer function remains fixed. However, it has been determined that the transfer function changes with changes in the operating environment of the implantable hearing device. For instance, changes in skin thickness and/or the tension of the skin overlying the implantable microphone result in changes to the transfer function. Such changes in skin thickness and/or tension may be the function of posture, biological factors (i.e., hydration) and/or ambient environmental conditions (e.g., heat, altitude, etc.). For instance, posture of the user may have a direct influence on the thickness and/or tension of the tissue overlying an implantable microphone. In cases where the implantable microphone is planted beneath the skin of a patient's skull, turning of the patient's head from side to side may increase or decrease the tension and/or change the thickness of the tissue overlying the microphone diaphragm. As a result, it is preferable that the cancellation filter be adaptive in order to provide cancellation that changes with changes in the operating environment of the implantable hearing instrument.

In this regard, it has been determined that it is desirable to generate a variable system model that is dependent upon the operating conditions/environment of the implantable hearing instrument. However, it will be appreciated that the operating environment of the implantable hearing system may not be directly observable by the system. That is, the operating environment may comprise a latent variable that may require estimation. For instance, the implantable hearing system may not have the ability to measure the thickness and/or tension of the tissue overlying an implantable microphone. Likewise, ambient environmental conditions (e.g., temperature, altitude) may not be observable by the hearing system. Accordingly, it may be desirable to generate a system that is operative to adapt to current operating conditions without having direct knowledge of those operating conditions. For instance, the system may be operative to iteratively adjust the transfer function until a transfer function appropriate for the current operating conditions is identified.

According to a first aspect, a system and method (i.e., utility) are provided for generating a variable system model that is at least partially dependent on a current operating environment of the hearing instrument. To generate such a variable system model, a first system model is generated that models a first relationship of output signals of an implantable microphone and a motion sensor for a first operating environment. Likewise, a second system model of a second relationship of output signals of the implantable microphone and the motion sensor is generated for a second operating environment that is different from the first operating environment. For instance, a first system model may be generated for a first user posture, and a second system model may be generated for a second user posture. In one arrangement, the user may be looking to the right when the first system model is generated, forward when a second system model is generated and/or to the left when a further system model is generated. Utilizing the first and second and/or additional system models that are dependent on different operating environments, the variable system model is generated is at least partially dependent on variable operating environments of the hearing instrument. In this regard, the variable system model may be operative to identify changes in the operating environment/conditions during operation of the hearing instrument and alter transfer function such that transfer function is altered for current operating environment/conditions.

In one arrangement, a variable system model may include coefficients that are each dependent on common variable that is related to the operating environment of the hearing instrument. Such a system may allow for more quickly adapting (e.g., minimizing) the transfer function than a system model that independently adjusts coefficients to minimize a transfer function. In one arrangement, this common variable may be a latent variable that is estimated by the system model. In such an arrangement, the system model may be operative to iteratively identify a value associated with the latent variable. For instance, such iterative analysis may entail filtering the motion sensor output using a plurality of different coefficients that are generated based on different values of the latent value. Further, the resulting filtered motion sensor outputs may be subtracted from the microphone output to generate a plurality of cancelled microphone outputs. Typically, the microphone output having the lowest energy level (e.g., residual energy) may be identified as having the most complete cancellation.

According to another aspect, a utility is provided for use in generating an adaptive system model that is dependent on the operating environment of the implantable hearing instrument. Initially, a plurality of system models that define relationships of corresponding outputs of an implantable microphone and a motion sensor are generated. These plurality of system models are associated with a corresponding plurality of different operating environments for the hearing instrument. Once the system models are generated, at least one parameter of the system models that varies between different system models is identified. A function may be fit to a set of values corresponding with at least one parameter that varies between the different system models. This function defines an operating environment variable. This function, as well as the plurality of system models, may then be utilized to generate a variable system model that is dependent on the operating environment variable.

As will be appreciated, each system model may include a variety of different parameters. That is, such system models are typically mathematical relationships of the outputs of implantable microphone and motion sensor. Accordingly, these mathematical relationships may include a number of parameters that may be utilized to identify changes between different system models caused by changes in the operating environment of the hearing instrument. For instance, each system model may include a plurality of parameters, including, without limitation, gain for the system model, a real pole, a real zero, as well as complex poles and complex zeroes. Further, it will be appreciated that the complex poles and complex zeroes may include radius and angle relative to the unit circle in the z dimension. Accordingly, a subset of these parameters may be selected for use in generating the variable system model. For instance, the gain of each system model may vary in relation to changes in the operating environment. In contrast, another parameter (e.g., real zero) may show little or no variance between different system models. Accordingly, it is desirable to identify one or more parameters that exhibit variance between the different system models.

Once one or more parameters that vary between different system models are identified, a function may be fit to these variables. However, it will be appreciated that, if a plurality of parameters are selected, additional processing may be required. For instance, it may be desirable to perform a principle component reduction in order to simplify the data set. That is, it may be desirable to reduce a multidimensional data set to a lower dimension for analysis. In one arrangement, the data set associated with the identified parameters may be reduced to a single dimension such that a line may be fit to the resulting data. Such a line may represent the limits of variance of the variable system model for changes in the operating environment. Stated otherwise, the function may define a latent variable that is associated with changes in the operating environment of the hearing system. Further, the relationship of the remaining parameters of the system models to the latent variable may be determined. For instance, regression analysis of each of the sets of parameters can be performed relative to the latent variable such that sensitivities for each set of parameters can be determined. These sensitivities (e.g., slopes) may be utilized to define a scalar or vector that may then be utilized to determine filter coefficients for the variable system model. In this regard, a system model may be generated having multiple coefficients that are dependent upon a single variable.

Accordingly, such a system model may be quickly adjusted to identify an appropriate transfer function for current operating conditions as only a single variable need be adjusted as opposed to adjusting individual filter coefficients to minimize error of the adaptive filter. That is, such a system may allow for rapid convergence on a transfer function optimized for a current operating condition.

According to another aspect, a utility is provided for controlling implantable hearing instrument. The utility includes providing an adaptive filter that is operative to model relationships of the outputs of an implantable microphone and the outputs of a motion sensor. The adaptive filter includes coefficients that are dependent on a latent variable associated with variable operating conditions of the implantable hearing instrument. Upon receiving outputs from an implantable microphone and motion sensor, the utility is operative to generate an estimate of the latent variable wherein the filter coefficients are adjusted based on the estimate of the latent variable. At such time, the output form the motion sensor may be filtered to produce a filtered motion output. This filtered motion output may then be removed from the microphone output to produce a cancelled signal. In one arrangement, a plurality of estimates of the latent variable may be generated wherein the filter coefficients are adjusted to each of the plurality of estimates. Accordingly, the motion output may be filtered for each estimate in order to generate a plurality of filtered motion outputs. Likewise, each of the plurality of the filtered motion outputs may be removed from copies of the microphone output to produce a plurality of cancelled signals. Accordingly, the cancelled signal with the smallest residual energy may be selected for subsequent processing. That is, the signal having the lowest residual energy value may be the signal that attains the greatest cancellation of the motion signal from the microphone output.

According to another aspect, a utility is provided for iteratively identifying and adjusting to a current operating condition of an implantable hearing instrument. The utility includes providing first and second adaptive filters that are operative to model relationships of the outputs of a motion sensor and the outputs of an implantable microphone. The first and second adaptive filters may be identical. Further, each adaptive filter utilizes filter coefficients that are dependent upon a latent variable that is associated with operating conditions of the implantable hearing instrument. Upon receiving outputs from the implantable microphone and motion sensor, the utility generates an estimate of the latent variable associated with the operating conditions of the instrument. The first filter then generates filter coefficients that are based on a value of the latent variable. The filter then produces a first filtered motion output. In contrast, the second filter generates filter coefficients that are based on a value that is a predetermined amount different than the estimate of the latent variable. In this regard, the first filter utilizes a value to generate coefficients that is based on the estimated value of the latent variable, and the second filter utilizes a value to generate coefficients that is slightly different that the estimated value of the latent variable. The first and second filtered motion signals are then removed from first and second copies of the microphone output to generate first and second cancelled signals. A comparison of the first and second cancelled signals may be made, and the estimate of the latent variable associated with operating conditions of the instrument may be updated.

One or all of the above related steps may be repeated until the energies/powers of the first and second cancelled signals are substantially equal. In this regard, the utility may iterate to an estimate of the latent variable that provides the lowest residual power of the cancelled signals. Further, it may be desirable to average the first and second cancelled signals to produce a third cancelled signal for subsequent processing.

In order to filter the motion output using first and second filters, as well as remove the filtered motion outputs from the microphone output, the utility may split the received outputs from the implantable microphone and motion sensor into two separate channels. Accordingly, filtering and subtraction of the filtered signals may occur in two separate channels within the system. Further, such processes may be performed concurrently.

DETAILED DESCRIPTION OF THE INVENTION

Reference will now be made to the accompanying drawings, which at least assist in illustrating the various pertinent features of the present invention. In this regard, the following description of a hearing instrument is presented for purposes of illustration and description. Furthermore, the description is not intended to limit the invention to the form disclosed herein. Consequently, variations and modifications commensurate with the following teachings, and skill and knowledge of the relevant art, are within the scope of the present invention. The embodiments described herein are further intended to explain the best modes known of practicing the invention and to enable others skilled in the art to utilize the invention in such, or other embodiments and with various modifications required by the particular application(s) or use(s) of the present invention.

Figure 1:
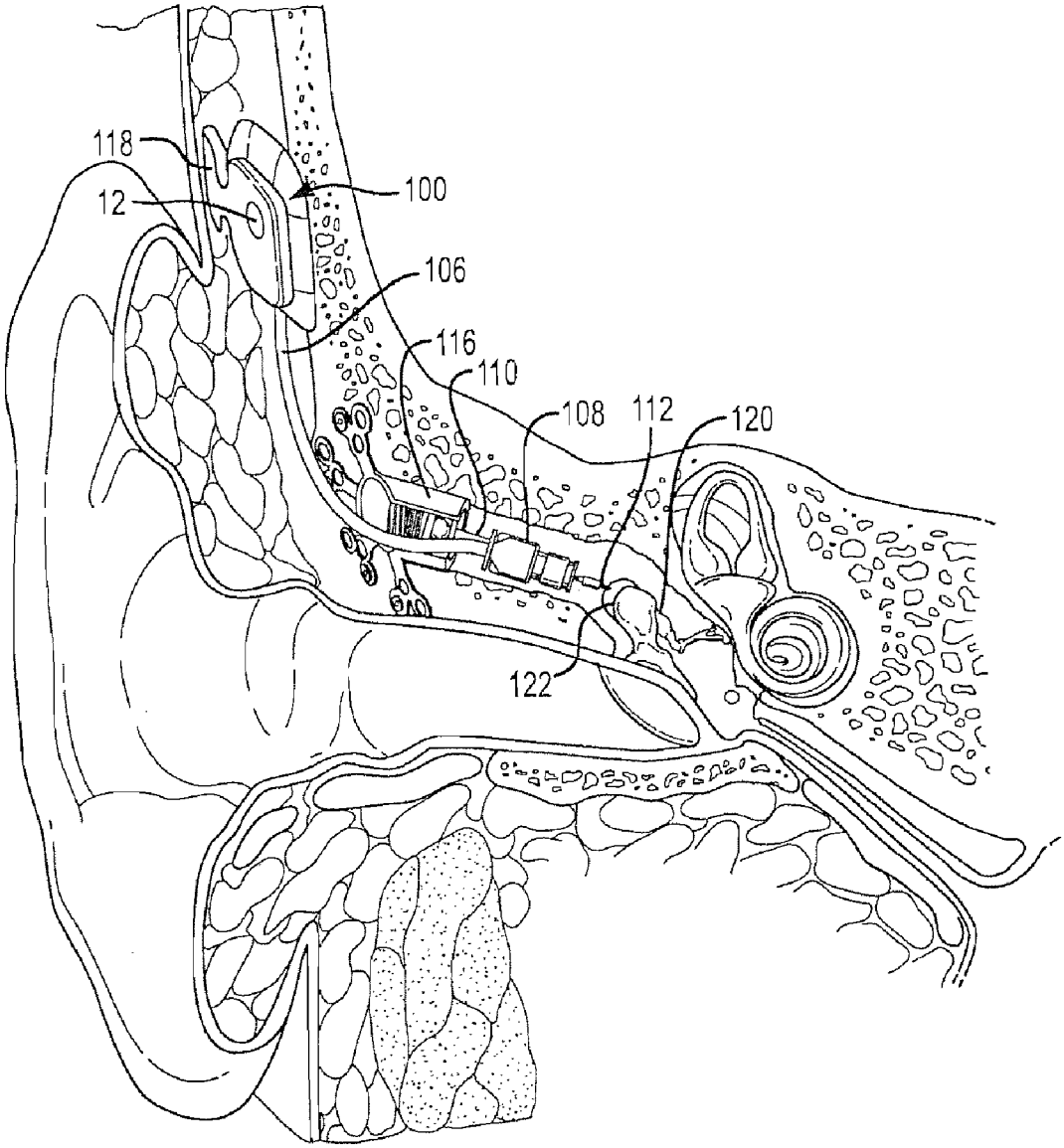
FIG. 1 illustrates a fully implantable hearing instrument as implanted in a wearer's skull.

FIG. 1 illustrates one application of the present invention. As illustrated, the application comprises a fully implantable hearing instrument system. As will be appreciated, certain aspects of the present invention may be employed in conjunction with semi-implantable hearing instruments as well as fully implantable hearing instruments, and therefore the illustrated application is for purposes of illustration and not limitation.

In the illustrated system, a biocompatible implant capsule 100 is located subcutaneously on a patient's skull. The implant capsule 100 includes a signal receiver 118 (e.g., comprising a coil element) and a microphone diaphragm 12 that is positioned to receive acoustic signals through overlying tissue. The implant housing 100 may further be utilized to house a number of components of the fully implantable hearing instrument. For instance, the implant capsule 100 may house an energy storage device, a microphone transducer, and a signal processor. Various additional processing logic and/or circuitry components may also be included in the implant capsule 100 as a matter of design choice. Typically, a signal processor within the implant capsule 100 is electrically interconnected via wire 106 to a transducer 108.

The transducer 108 is supportably connected to a positioning system 110, which in turn, is connected to a bone anchor 116 mounted within the patient's mastoid process (e.g., via a hole drilled through the skull). The transducer 108 includes a connection apparatus 112 for connecting the transducer 108 to the ossicles 120 of the patient. In a connected state, the connection apparatus 112 provides a communication path for acoustic stimulation of the ossicles 120, e.g., through transmission of vibrations to the incus 122.

During normal operation, ambient acoustic signals (i.e., ambient sound) impinge on patient tissue and are received transcutaneously at the microphone diaphragm 12. Upon receipt of the transcutaneous signals, a signal processor within the implant capsule 100 processes the signals to provide a processed audio drive signal via wire 106 to the transducer 108. As will be appreciated, the signal processor may utilize digital processing techniques to provide frequency shaping, amplification, compression, and other signal conditioning, including conditioning based on patient-specific fitting parameters. The audio drive signal causes the transducer 108 to transmit vibrations at acoustic frequencies to the connection apparatus 112 to effect the desired sound sensation via mechanical stimulation of the incus 122 of the patient.

Upon operation of the transducer 108, vibrations are applied to the incus 122, however, such vibrations are also applied to the bone anchor 116. The vibrations applied to the bone anchor are likewise conveyed to the skull of the patient from where they may be conducted to the implant capsule 100 and/or to tissue overlying the microphone diaphragm 12. Accordingly such vibrations may be applied to the microphone diaphragm 12 and thereby included in the output response of the microphone. Stated otherwise, mechanical feedback from operation of the transducer 108 may be received by the implanted microphone diaphragm 12 via a feedback loop formed through tissue of the patient. Further, application of vibrations to the incus 122 may also vibrate the eardrum thereby causing sound pressure waves, which may pass through the ear canal where they may be received by the implanted microphone diaphragm 12 as ambient sound. Further, biological sources may also cause vibration (e.g., biological noise) to be conducted to the implanted microphone through the tissue of the patient. Such biological sources may include, without limitation, vibration caused by speaking, chewing, movement of patient tissue over the implant microphone (e.g. caused by the patient turning their head), and the like.

Figure 2:
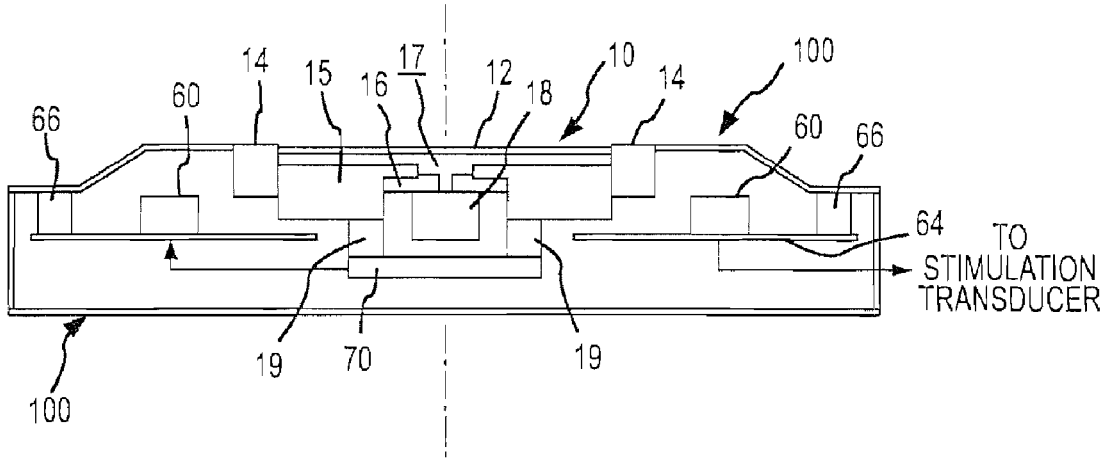
FIG. 2 is a schematic, cross-sectional illustration of one embodiment of the present invention.

FIG. 2 shows one embodiment of an implantable microphone 10 that utilizes a motion sensor 70 to reduce the effects of noise, including mechanical feedback and biological noise, in an output response of the implantable microphone 10. As shown, the microphone 10 is mounted within an opening of the implant capsule 100. The microphone 10 includes an external diaphragm 12 (e.g., a titanium membrane) and a housing having a surrounding support member 14 and fixedly interconnected support members 15, 16, which combinatively define a chamber 17 behind the diaphragm 12. The microphone 10 may further include a microphone transducer 18 that is supportably interconnected to support member 15 and interfaces with chamber 17, wherein the microphone transducer 18 provides an electrical output responsive to vibrations of the diaphragm 12. The microphone transducer 18 may be defined by any of a wide variety of electroacoustic transducers, including for example, capacitor arrangements (e.g., electret microphones) and electrodynamic arrangements.

One or more processor(s) and/or circuit component(s) 60 and an on-board energy storage device (not shown) may be supportably mounted to a circuit board 64 disposed within implant capsule 100. In the embodiment of FIG. 2, the circuit board is supportably interconnected via support(s) 66 to the implant capsule 100. The processor(s) and/or circuit component(s) 60 may process the output signal of microphone transducer 18 to provide a drive signal to an implanted transducer. The processor(s) and/or circuit component(s) 60 may be electrically interconnected with an implanted, inductive coil assembly (not shown), wherein an external coil assembly (i.e., selectively locatable outside a patient body) may be inductively coupled with the inductive coil assembly to recharge the on-board energy storage device and/or to provide program instructions to the processor(s), etc.

Vibrations transmitted through the skull of the patient cause vibration of the implant capsule 100 and microphone 10 relative to the skin that overlies the microphone diaphragm 12. Movement of the diaphragm 12 relative to the overlying skin may result in the exertion of a force on the diaphragm 12. The exerted force may cause undesired vibration of the diaphragm 12, which may be included in the electrical output of the transducer 18 as received sound. As noted above, two primary sources of skull borne vibration are feedback from the implanted transducer 108 and biological noise. In either case, the vibration from these sources may cause undesired movement of the microphone 10 and/or movement of tissue overlying the diaphragm 12.

To actively address such sources of vibration and the resulting undesired movement between the diaphragm 12 and overlying tissue, the present embodiment utilizes the motion sensor 70 to provide an output response proportional to the vibrational movement experienced by the implant capsule 100 and, hence, the microphone 10. Generally, the motion sensor 70 may be mounted anywhere within the implant capsule 100 and/or to the microphone 10 that allows the sensor 70 to provide an accurate representation of the vibration received by the implant capsule 100, microphone 10, and/or diaphragm 12. In a further arrangement (not shown), the motion sensor may be a separate sensor that may be mounted to, for example, the skull of the patient. What is important is that the motion sensor 70 is substantially isolated from the receipt of the ambient acoustic signals that pass transcutaneously through patient tissue and which are received by the microphone diaphragm 12. In this regard, the motion sensor 70 may provide an output response/signal that is indicative of motion (e.g., caused by vibration and/or acceleration) whereas the microphone transducer 18 may generate an output response/signal that is indicative of both transcutaneously received acoustic sound and motion. Accordingly, the output response of the motion sensor may be removed from the output response of the microphone to reduce the effects of motion on the implanted hearing system.

The motion sensor output response is provided to the processor(s) and/or circuit component(s) 60 for processing together with the output response from microphone transducer 18. More particularly, the processor(s) and/or circuit component(s) 60 may scale and frequency-shape the motion sensor output response to vibration (e.g., filter the output) to match the output response of the microphone transducer to vibration 18 (hereafter output response of the microphone). In turn, the scaled, frequency-shaped motion sensor output response may be subtracted from the microphone output response to produce a net audio signal or net output response. Such a net output response may be further processed and output to an implanted stimulation transducer for stimulation of a middle ear component or cochlear implant. As may be appreciated, by virtue of the arrangement of the FIG. 2 embodiment, the net output response will reflect reduced sensitivity to undesired signals caused by vibration (e.g., resulting form mechanical feedback and/or biological noise).

Figure 3:
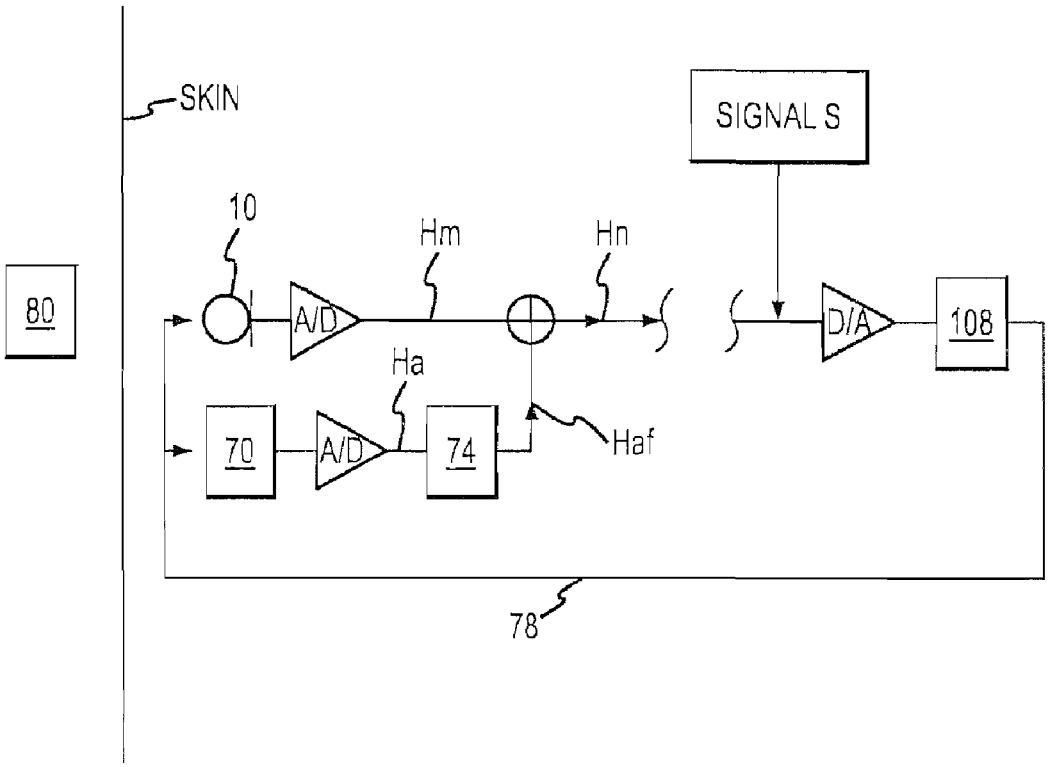
FIG. 3 is a schematic illustration of an implantable microphone incorporating a motion sensor.

Accordingly, to remove noise, including feedback and biological noise, it is necessary to measure the acceleration of the microphone 10. FIG. 3 schematically illustrates an implantable hearing system that incorporates an implantable microphone 10 and motion sensor 70. As shown, the motion sensor 70 further includes a filter 74 that is utilized for matching the output response Ha of the motion sensor 70 to the output response Hm of the microphone assembly 10. Of note, the microphone 10 is subject to desired acoustic signals (i.e., from an ambient source 80), as well as undesired signals from biological sources (e.g., vibration caused by talking, chewing etc.) and feedback from the transducer 108 received by a tissue feedback loop 78. In contrast, the motion sensor 70 is substantially isolated from the ambient source and is subjected to only the undesired signals caused by the biological source and/or by feedback received via the feedback loop 78. Accordingly, the output of the motion sensor 70 corresponds the undesired signal components of the microphone 10. However, the magnitude of the output channels (i.e., the output response Hm of the microphone 10 and output response Ha of the motion sensor 70) may be different and/or shifted in phase. In order to remove the undesired signal components from the microphone output response Hm, the filter 74 and/or the system processor may be operative to filter one or both of the responses to provide scaling, phase shifting and/or frequency shaping. The output responses Hm and Ha of the microphone 10 and motion sensor 70 are then combined by summation unit 76, which generates a net output response Hn that has a reduced response to the undesired signals.

In order to implement a filter 74 for scaling and/or phase shifting the output response Ha of a motion sensor 70 to remove the effects of feedback and/or biological noise from a microphone output response Hm, a system model of the relationship between the output responses of the microphone 10 and motion sensor 70 must be identified/developed. That is, the filter 74 must be operative to manipulate the output response Ha of the motion sensor 70 to biological noise and/or feedback, to replicate the output response Hm of the microphone 10 to the same biological noise and/or feedback. In this regard, the filtered output response Haf and Hm may be of substantially the same magnitude and phase prior to combination (e.g., subtraction/cancellation). However, it will be noted that such a filter 74 need not manipulate the output response Ha of the motion sensor 70 to match the microphone output response Hm for all operating conditions. Rather, the filter 74 needs to match the output responses Ha and Hm s over a predetermined set of operating conditions including, for example, a desired frequency range (e.g., an acoustic hearing range) and/or one or more pass bands. Note also that the filter 74 need only accommodate the ratio of microphone output response Hm to the motion sensor output response Ha to acceleration, and thus any changes of the feedback path which leave the ratio of the responses to acceleration unaltered have little or no impact on good cancellation. Such an arrangement thus has significantly reduced sensitivity to the posture, clenching of teeth, etc., of the patient.

Figure 4:
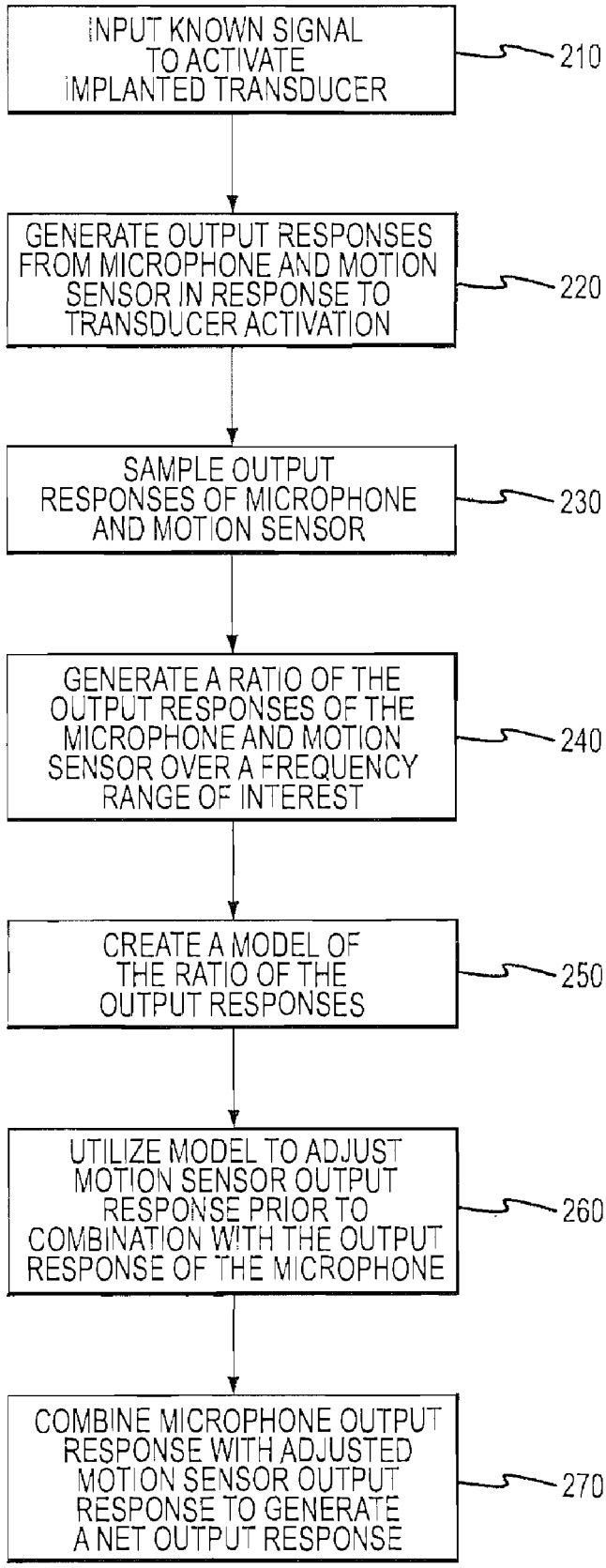
FIG. 4 is a process flow sheet.

Referring to FIG. 4, one method is provided for generating a system model that may be implemented as a digital filter for removing undesired signals from an output of an implanted microphone 10. However, it will be appreciated that other methods for modeling the system may be utilized and are within the scope of the present invention. As will be appreciated, a digital filter is effectively a mathematical manipulation of set of digital data to provide a desired output. Stated otherwise, the digital filter 74 may be utilized to mathematically manipulate the output response Ha of the motion sensor 70 to match the output response Hm of the microphone 10. FIG. 4 illustrates a general process 200 for use in generating a model to mathematically manipulate the output response Ha of the motion sensor 70 to replicate the output response Hm of the microphone 10 for a common stimulus. Specifically, in the illustrated embodiment, the common stimulus is feedback caused by the actuation of an implanted transducer 108. To better model the output responses Ha and Hm, it is generally desirable that little or no stimulus of the microphone 10 and/or motion sensor 70 occur from other sources (e.g., ambient or biological) during at least a portion of the modeling process.

Initially, a known signal S (e.g., a MLS signal) is input (210) into the system to activate the transducer 108. This may entail inputting (210) a digital signal to the implanted capsule and digital to analog (D/A) converting the signal for actuating of the transducer 108. Such a drive signal may be stored within internal memory of the implantable hearing system, provided during a fitting procedure, or generated (e.g., algorithmically) internal to the implant during the measurement. Alternatively, the drive signal may be transcutaneously received by the hearing system. In any case, operation of the transducer 108 generates feedback that travels to the microphone 10 and motion sensor 70 through the feedback path 78. The microphone 10 and the motion sensor 70 generate (220) responses, Hm and Ha respectively, to the activation of the transducer 108. These responses (Ha and Hm) are sampled (230) by an A/D converter (or separate A/D converters). For instance, the actuator 108 may be actuated in response to the input signal(s) for a short time period (e.g., a quarter of a second) and the output responses may be each be sampled (230) multiple times during at least a portion of the operating period of the actuator. For example, the outputs may be sampled (230) at a 16000 Hz rate for one eighth of a second to generate approximately 2048 samples for each response Ha and Hm. In this regard, data is collected in the time domain for the responses of the microphone (Hm) and accelerometer (Ha).

Figure 5:
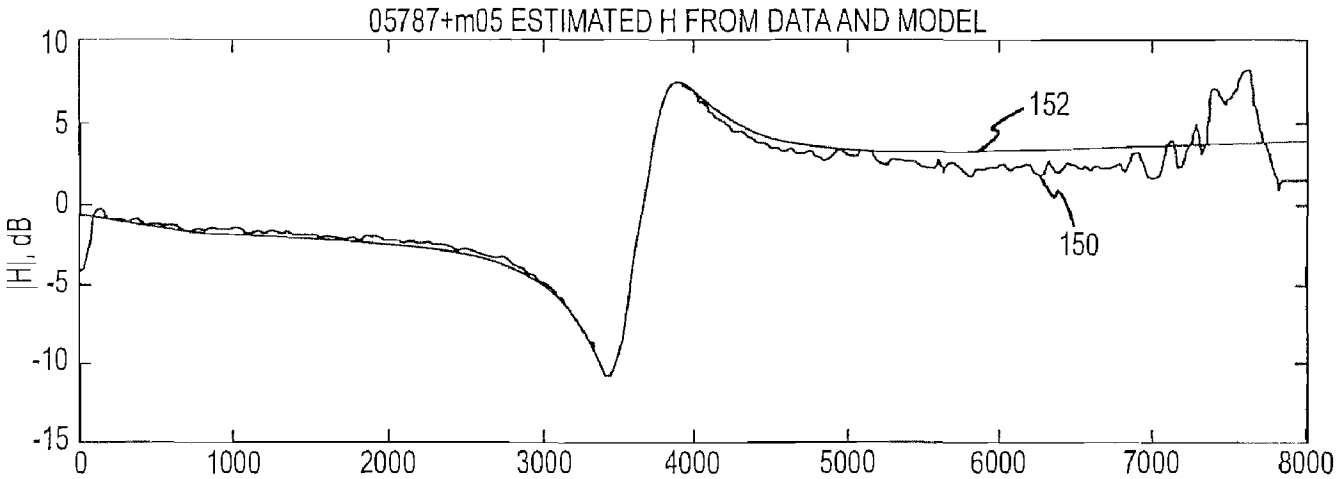
FIG. 5 is a plot of the ratios of the magnitudes of output responses of an implanted microphone and motion sensor.
Figure 6:
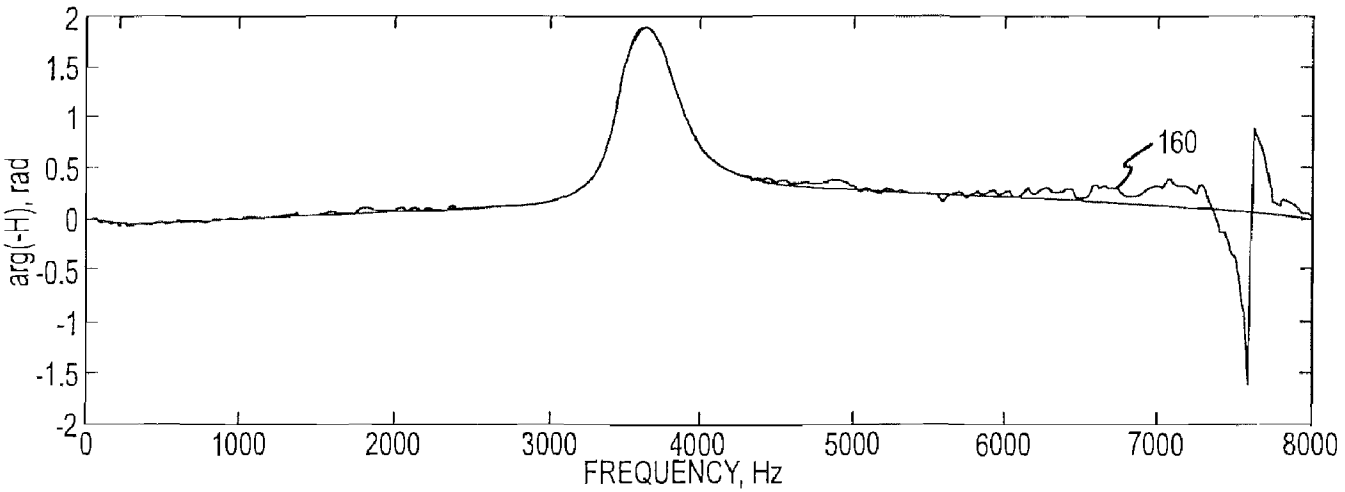
FIG. 6 is a plot of the ratios of the phases of output responses of an implanted microphone and motion sensor.

The time domain output responses of the microphone and accelerometer may be utilized to create a mathematical model between the responses Ha and Hm. In another embodiment, the time domain responses are transformed into frequency domain responses. For instance, each spectral response is estimated by non-parametric (Fourier, Welch, Bartlett, etc.) or parametric (Box-Jenkins, state space analysis, Prony, Shanks, Yule-Walker, instrumental variable, maximum likelihood, Burg, etc.) techniques. A plot of the ratio of the magnitudes of the transformed microphone response to the transformed accelerometer response over a frequency range of interest may then be generated (240). FIG. 5 illustrates the ratio of the output responses of the microphone 10 and motion sensor 70 using a Welch spectral estimate. As shown, the jagged magnitude ratio line 150 represents the ratio of the transformed responses over a frequency range between zero and 8000 Hz. Likewise, a plot of a ratio of the phase difference between the transformed signals may also be generated as illustrated by FIG. 6, where the jagged line 160 represents the ratio of the phases the transformed microphone output response to the transformed motion sensor output response. It will be appreciated that similar ratios may be obtained using time domain data by system identification techniques followed by spectral estimation.

The plots of the ratios of the magnitudes and phases of the microphone and motion sensor responses Hm and Ha may then be utilized to create (250) a mathematical model (whose implementation is the filter) for adjusting the output response Ha of the motion sensor 70 to match the output response Hm of the microphone 10. Stated otherwise, the ratio of the output responses provides a frequency response between the motion sensor 70 and microphone 10 and may be modeled create a digital filter. In this regard, the mathematical model may consist of a function fit to one or both plots. For instance, in FIG. 5, a function 152 may be fit to the magnitude ratio plot 150. The type and order of the function(s) may be selected in accordance with one or more design criteria, as will be discussed herein. Normally complex frequency domain data, representing both magnitude and phase, are used to assure good cancellation. Once the ratio(s) of the responses are modeled, the resulting mathematical model may be implemented as the digital filter 74. As will be appreciated, the frequency plots and modeling may be performed internally within the implanted hearing system, or, the sampled responses may be provided to an external processor (e.g., a PC) to perform the modeling.

Once a function is properly fitted to the ratio of responses, the resulting digital filter may then be utilized (260) to manipulate (e.g., scale and/or phase shift) the output response Ha of the motion sensor prior to its combination with the microphone output response Hm. The output response Hm of the microphone 10 and the filtered output response Haf of the motion sensor may then be combined (270) to generate a net output response Hn (e.g., a net audio signal).

A number of different digital filters may be utilized to model the ratio of the microphone and motion sensor output responses. Such filters may include, without limitation, LMS filters, max likelihood filters, adaptive filters and Kalman filters. Two commonly utilized digital filter types are finite impulse response (FIR) filters and infinite impulse response (IIR) filters. Each of the types of digital filters (FIR and IIR) possess certain differing characteristics. For instance, FIR filters are unconditionally stable. In contrast, IIR filters may be designed that are either stable or unstable. However, IIR filters have characteristics that are desirable for an implantable device. Specifically, IIR filters tend to have reduced computational requirements to achieve the same design specifications as an FIR filter. As will be appreciated, implantable device often have limited processing capabilities, and in the case of fully implantable devices, limited energy supplies to support that processing. Accordingly, reduced computational requirements and the corresponding reduced energy requirements are desirable characteristics for implantable hearing instruments. In this regard, it may be advantageous to use an IIR digital filter to remove the effects of feedback and/or biological noise from an output response of an implantable microphone.

The following illustrates one method for modeling a digital output of an IIR filter to its digital input, which corresponds to mechanical feedback of the system as measured by a motion sensor. Accordingly, when the motion sensor output response Ha is passed through the filter, the output of filter, Haf, is substantially the same as the output response Hm of the implanted microphone to a common excitation (e.g., feedback, biological noise etc.). The current input to the digital filter is represented by x(t) and the current output of the digital filter is represented by y(t). Accordingly, a model of the system may be represented as:

$$y(t)=B(z)/A(z)x(t)+C(z)/D(z)\epsilon(t) \quad \text{Eq. 1}$$

In this system, B(z)/A(z) is the ratio of the microphone output response (in the z domain) to the motion sensor output response (in z domain), x(t) is the motion sensor output, and y(t) is the microphone output. The motion sensor output is used as the input x(t) because the intention of the model is to determine the ratio B/A, as if the motion sensor output were the cause of the microphone output. $\epsilon$ (t) represents independently identically distributed noise that is independent of the input x(t), and might physically represent the source of acoustic noise sources in the room and circuit noise. $\epsilon$ is colored by a filtering process represented by C(z)/D(z), which represents the frequency shaping due to such elements as the fan housing, room shape, head shadowing, microphone response and electronic shaping. Other models of the noise are possible such as moving average, autoregressive, or white noise, but the approach above is most general and is a preferred embodiment. A simple estimate of B/A can be performed if the signal to noise ratio, that is the ratio of (B/A x(t))/(C/D $\epsilon$(t)) is large, by simply ignoring the noise. Accordingly, the only coefficients that need to be defined are A and B. As will be appreciated for an IIR filter, one representation of the general digital filter equation written out is:

$$y(t)=b_o t+b_1x(t-1)+b_2x(t-2)+\ldots b_px(t-p)-a_1y(t-1)-a_2y(t-2)-\ldots a_qy(t-q) \quad \text{Eq. 2}$$

where p is the number of coefficients for b and is often called the number of zeros, and q is the number of coefficients for a and is called the number of poles. As it can be seen, the current output y(t) depends on the q previous output samples {y(t−1), y(t−2), . . . y(t−q)}, thus the IIR filter is a recursive (i.e., feedback) system. The digital filter equation give rise to the transfer function:

$$H(z)=\frac{(b_o+b_1z^{-1}+b_2z^{-2}+\ldots b_pz^{-p})}{(1+a_1z^{-1}+a_2z^{-2}+\ldots a_qz^{-q})} \quad \text{Eq. 3}$$

in the z domain, or $$H(\omega)=\frac{(b_o+b_1e^{-i\omega}+b_2e^{-2i\omega}+\ldots b_pe^{-pi\omega})}{(1+a_1e^{-i\omega}+a_2e^{-2i\omega}+\ldots a_qe^{-qi\omega})} \quad \text{Eq. 4}$$

in the frequency domain.

Different methods may be utilized to select coefficients for the above equations based on the ratio(s) of the responses of the microphone output response to the motion sensor output response as illustrated above in FIGS. 5 and/or 6. Such methods include, without limitation, least mean squares, Box Jenkins, maximum likelihood, parametric estimation methods (PEM), maximum a posteriori, Bayesian analysis, state space, instrumental variables, adaptive filters, and Kalman filters. The selected coefficients should allow for predicting what the output response of the microphone should be based on previous motion sensor output responses and previous output responses of the microphone. The IIR filter is computationally efficient, but sensitive to coefficient accuracy and can become unstable. To avoid instability, the order of the filter is preferably low, and it may be rearranged as a more robust filter algorithm, such as biquadratic sections, lattice filters, etc. To determine stability of the system, A(0) (i.e., the denominator of the transfer function) is set equal to zero and all pole values in the Z domain where this is true are determined. If all these pole values are less than one in the z domain, the system is stable. Accordingly, the selected coefficients may be utilized for the filter.

By generating a filter that manipulates the motion sensor output response to substantially match the microphone output response for mechanical feedback, the filter will also be operative to manipulate the motion sensor output response to biological noise substantially match the microphone output response to the same biological noise. That is, the filter is operative to least partially match the output responses for any common stimuli. Further, the resulting combination of the filter for filtering the motion sensor output response and the subsequent subtraction of the filtered motion sensor output response from the microphone output response represents a cancellation filter. The output of this cancellation filter is a canceled signal that is an estimate of the microphone response to acoustic (e.g., desired) signals.

As discussed above, the filter is an algorithm (e.g., a higher order mathematical function) having static coefficients. That is, the resulting filter has a fixed set of coefficients that collectively define the transfer function of the filter. Such a filter works well provided that the transfer function remains fixed. However, in practice the transfer function changes with the operating environment of the implantable hearing instrument. For instance, changes in thickness and/or tension of skin overlying the implantable microphone change the operating environment of the implantable hearing instrument. Such changes in the operating environment may be due to changes in posture of the user, other biological factors, such as changes in fluid balance and/or ambient environment conditions, such as temperature, barometric pressure etc. A filter having static coefficients cannot adjust to changes in operating conditions/environment of the implantable hearing system. Accordingly, changes in the operating conditions/environment may result in feedback and/or noise being present in the canceled signal. Therefore, to provide improved cancellation, the filter may be made to be adaptive to account for changes in the operating environment of the implantable hearing instrument.

Figure 7:
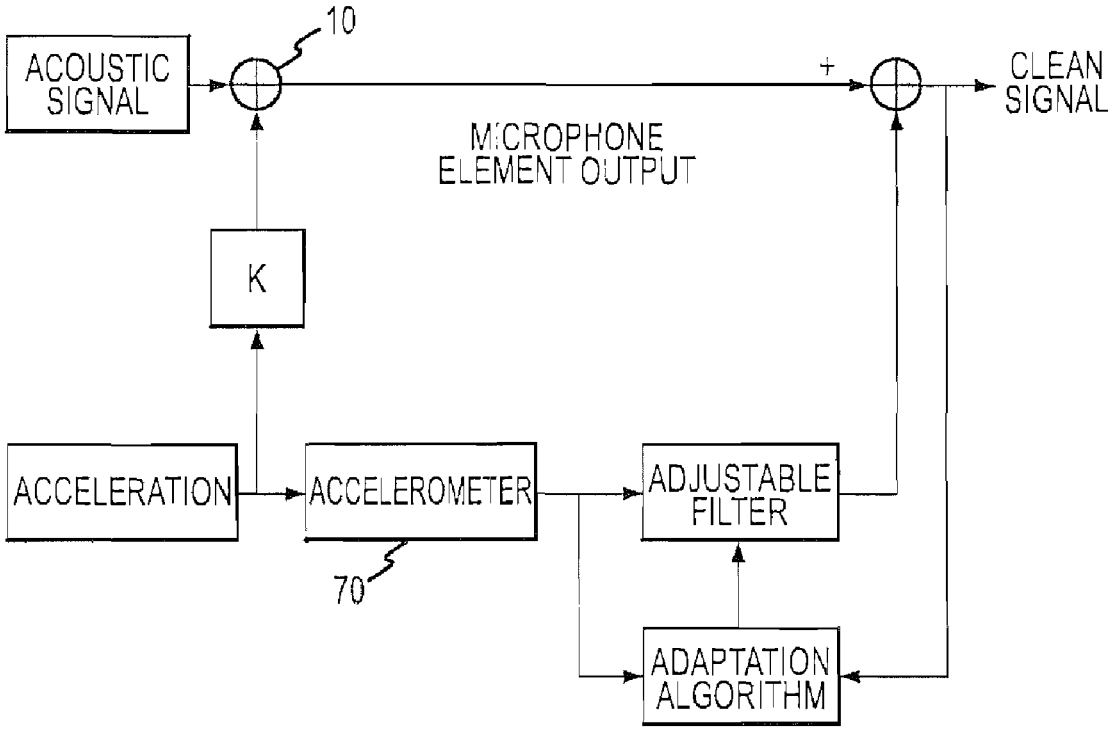
FIG. 7 is a schematic illustration of one embodiment of an implanted hearing system that utilizes an adaptive filter.

FIG. 7 illustrates one embodiment of a system that utilizes an adaptive filter. In this embodiment, biological noise is modeled by the acceleration at the microphone assembly filtered through a linear process K. This signal is added to the acoustic signal at the surface of the microphone element. In this regard, the microphone 10 sums the signals. If the combination of K and the acceleration are known, the combination of the accelerometer output and the adaptive/adjustable filter can be adjusted to be K. This is then subtracted out of the microphone output at point. This will result in the cleansed or net audio signal with a reduced biological noise component. This net signal may then be passed to the signal processor where it can be processed by the hearing system.

Adaptive filters can perform this process using the ambient signals of the acceleration and the acoustic signal plus the filtered acceleration. As known to those skilled in the art, the adaptive algorithm and adjustable filter can take on many forms, such as continuous, discrete, finite impulse response (FIR), infinite impulse response (IIR), lattice, systolic arrays, etc.,—see Haykin for a more complete list—all of which have be applied successfully to adaptive filters. Well-known algorithms for the adaptation algorithm include stochastic gradient-based algorithms such as the least-mean-squares (LMS) and recursive algorithms such as RLS. There are algorithms which are numerically more stable such as the QR decomposition with RLS (QRD-RLS), and fast implementations somewhat analogous to the FFT. The adaptive filter may incorporate an observer, that is, a module to determine one or more intended states of the microphone/motion sensor system. The observer may use one or more observed state(s)/variable(s) to determine proper or needed filter coefficients. Converting the observations of the observer to filter coefficients may be performed by a function, look up table, etc. Adaptive algorithms especially suitable for application to lattice IIR filters may be found in, for instance, Regalia. Adaptation algorithms can be written to operate largely in the DSP "background," freeing needed resources for real-time signal processing.

As will be appreciated, adaptive filters are typically operative to adapt their performance based on the input signal to the filter. In this regard, the algorithm of an adaptive filter may be operative to use feedback to refine values of its filter coefficients and thereby enhance its frequency response. Generally, in adaptive cancellation, the algorithm contains the goal of minimizing a "loss function" J. The loss function is typically designed in such a way as to minimize the impact of mismatch. One common loss function in adaptive filters is the least mean square error. This is defined as:

$$J(\theta)=\tfrac{1}{2}E(\tilde{y}_m(\theta)^2) \qquad \text{Eq. 5}$$

where $\tilde{y}_m$ is a cancelled output of the microphone which represents the microphone output minus a prediction of the microphone response to undesired signals; where E is the expected value, and θ is a vector of the parameters (e.g., tap weight of multiple coefficients) that can be varied to minimize the value of J. This is to say, the algorithm has the goal of minimizing the average of the cancelled output signal squared. Setting the derivative of J to zero finds the extreme, including the minimum, values:

$$\partial_\theta J=\tfrac{1}{2}E(\partial_\theta(\tilde{y}_m(\theta)^2))=E(\tilde{y}_m(\theta)\partial_\theta\tilde{y}_m(\theta))=0 \qquad \text{Eq. 6}$$

If this equation is then solved for the vector θ, J will be minimized, so that as much of the signal correlated with the accelerometer will be removed from the cancelled mic output.

Unfortunately, this is a difficult equation to solve. The expectation cannot be found in a finite amount of time, since it is the average over all time. One approach that has been used in the past makes the assumption that the minimization of the expectation value is the same as updating the coefficients in the following manner:

$$\theta_{k+1}=\theta_k-\mu\tilde{y}_m(\theta_k)\partial\tilde{y}_m(\theta_k) \qquad \text{Eq. 7}$$

where $\theta_k$ is the value of the parameter vector at time step k, and μ is a parameter called the learning matrix, which is a diagonal matrix with various real, positive values for its elements. The term $\partial\tilde{y}_m(\theta_k)$ is called the gradient. This approach is called the stochastic steepest descent approach, and allows the LMS algorithm to be implemented. The speed of convergence is set by the smallest element of μ; the larger the value of the $\mu_{ij}$ element, the faster the ith component of the θ vector will converge. If $\mu_{ij}$ is too large, however, the algorithm will be unstable. It is possible to replace the matrix μ with a scalar value μ, which sometimes makes the matrix easier to implement. For the algorithm to be stable, the scalar value of μ must be less than or equal to the smallest nonzero element of the original μ matrix. If there are a lot of parameters, and a large difference between the size of the t elements in the learning matrix, replacing the μ matrix with a μ scalar will result in very slow convergence.

Another difficulty is in finding the gradient $\partial\tilde{y}_m(\theta)$. If one makes the assumption that the form of $H_{mv}/H_{av}$ is that of a FIR (finite impulse response) filter, taking the derivative with respect to θ (which is then the vector of tap weights on the filter) leads to a nonrecursive linear set of equations that can be applied directly to updating the FIR filter. Such a filter (with an appropriately value of μ is intrinsically stable. This type of structure leads to an algorithm which removes any signal on the mic that is correlated with the acc, at least to the order of the filter. Unfortunately, a FIR filter can be a poor model of the transfer function. FIR filters do not model poles well without numerous (e.g., hundreds) of terms. As a result, an FIR model could lead to a great deal of computational complexity.

Most adaptive filter algorithms work to remove any correlation between the output and the input. Removing any signal correlated with the accelerometer output (i.e., acc output) acc is not desirable for all signals; a sinewave input will result in a sinewave output of the MET which will be correlated with the input. As a result, an FIR implementation may attempt to remove the sinewave component completely, so that a pure tone will be rapidly and completely removed from the output signal. Such is also true of the feedback control using the implant output instead of the acc output, provided the same type of algorithm is used. One demonstration of noise removal in adaptive filters demonstrated the rapid and complete removal of a warbling "ambulance" tone; removal of alarm tones, many of which are highly correlated, would be a drawback for any patient using such a device. Music is also highly self-correlated, so that music quality often suffers in conventional hearing aids at the hands of feedback control circuitry. Fortunately, the autocorrelation of speech has support only for very small values of lags, and thus is not well self-correlated, and is not usually greatly impacted by feedback cancellation systems in conventional hearing aids.

Accordingly, in some instances an IIR (infinite impulse response) filter may be a better choice for the filter model. Such a filter can compactly and efficiently compute with a few terms transfer functions that would take many times (sometimes hundreds) as many FIR terms. Unfortunately, it has traditionally been very difficult to implement adaptive IIR filters. The issues are primarily with stability and computation of the gradient. The traditional approaches to this problem are all computationally intensive or can produce unsatisfactory results.

IIR filters, unlike FIR filters, contain poles in their response and can become unstable with any combination of input parameters that result in a pole outside of the unit circle in z space. As a result, the stability of a set of coefficients must be determined before presentation to the filter. With a conventional "direct" form of IIR filter, it is computationally intensive to determine the stability. Other forms of IIR filter, such as the lattice filter, are easier to stabilize but require more computational steps. In the case of the lattice filter, there will be about 4 times as many arithmetic operations performed as with the direct form.

The gradient, $\partial\tilde{y}_m(\theta_k)$, of IIR filters can also be difficult to compute. The most common approaches are to abandon the proper use of minimization entirely and adopt what is known as an equation error approach. Such an approach uses an FIR on both of the channels, and results in a simple, easy to program structure that does not minimize the residual energy.

Another approach is to use an iterative structure to calculate the gradient. This approach is generally superior to using equation error, but it is computationally intensive, requiring about as much computation as the IIR filter itself.

A conventional adaptive IIR filter will normally do its best to remove any signal on the mic that is correlated with the acc, including removing signals such as sinewaves, music and alarm tones. As a result, the quality of the signal may suffer, or the signal may be eliminated altogether. Finally, the IIR filter, like the FIR filter, can have slow convergence due to the range between the maximum and minimum values of μ.

Figure 8:
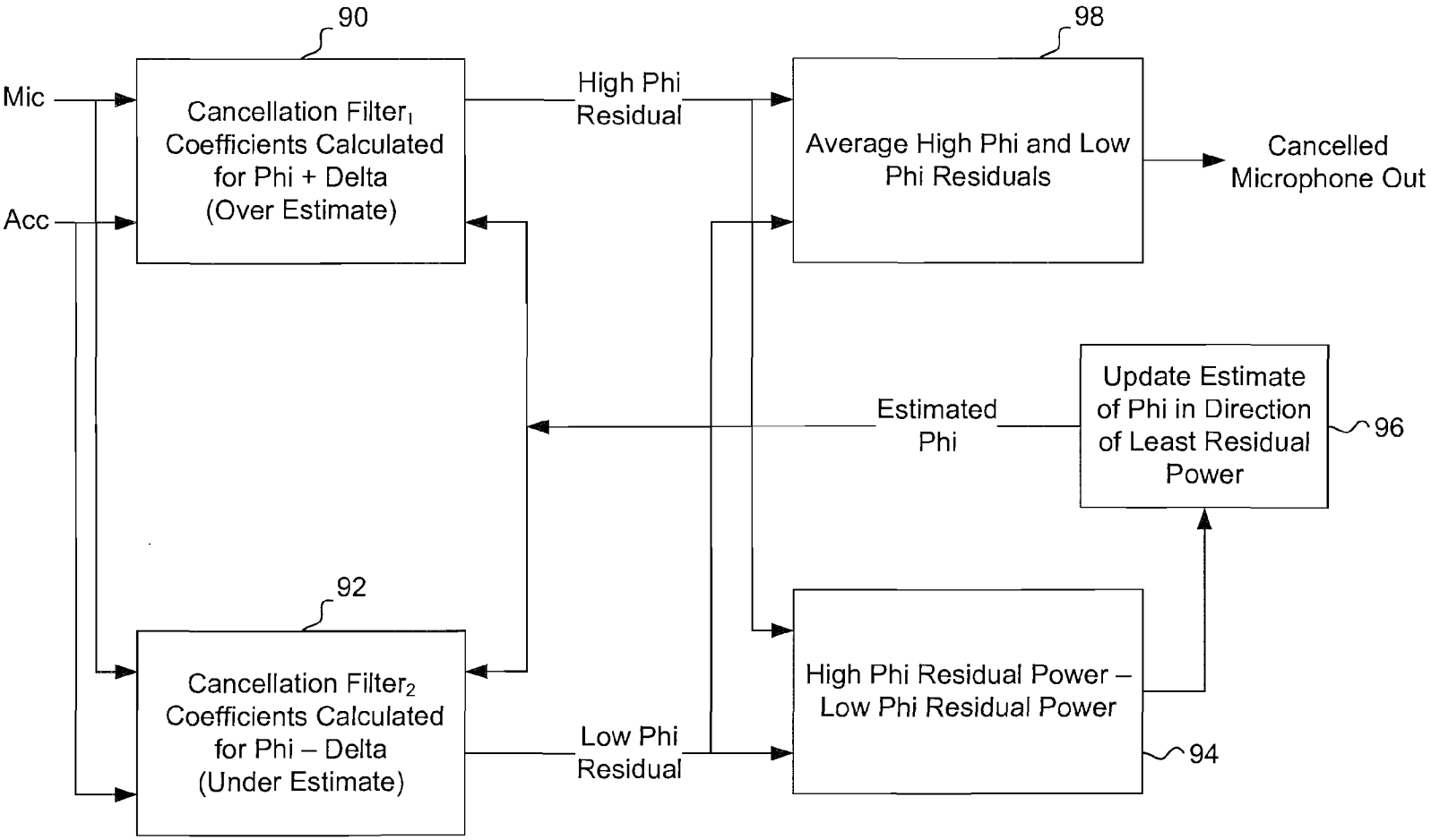
FIG. 8 is a schematic illustration of one embodiment of an implanted hearing system that utilizes first and second cancellation filters.

FIG. 8 provides a system that utilizes an adaptive filter arrangement that overcomes the drawbacks of some existing filters. In this regard, the system utilizes an adaptive filter that is computationally efficient, converges quickly, remains stable, and is not confused by correlated noise. To produce such an adaptive filter, the system of FIG. 8 utilizes an adaptive filter that adapts based on the current operating conditions (e.g., operating environment) of the implantable hearing instrument. However, it will be appreciated that such operating conditions are often not directly observable. That is, the operating conditions form a latent parameter. Accordingly, the system is operative to estimate this 'latent' parameter for purposes of adapting to current operating conditions. Stated otherwise, the system utilizes a latent variable adaptive filter.

The latent variable adaptive filter (LVAF) is computationally efficient, converges quickly, can be easily stabilized, and its performance is robust in the presence of correlated noise. It is based on IIR filters, but rather than adapting all the coefficients independently, it uses the functional dependence of the coefficients on a latent variable. In statistics, a latent variable is one which is not directly observable, but that can be deduced from observations of the system. An example of a latent variable is the thickness of the tissue over the microphone. This cannot be directly measured, but can be deduced from the change in the microphone motion sensor (i.e., mic/acc) transfer function.

Another hidden variable may be user "posture." It has been noted that some users of implantable hearing instruments experience difficulties with feedback when turning to the left or the right (usually one direction is worse) if the (nonadaptive) cancellation filter has been optimized with the patient facing forward. Posture could be supposed to have one value at one "extreme" position, and another value at a different "extreme" position. "Extreme," in this case, is flexible in meaning; it could mean at the extreme ranges of the posture, or it could mean a much more modest change in posture that still produces different amounts of feedback for the patient. Posture in this case may be a synthetic hidden variable (SHV), in that the actual value of the variable is arbitrary; what is important is that the value of the hidden variable changes with the different measurements. For instance, the value of the SHV for posture could be "+90" for the patient facing all the way to the right, and "−90" for a patient facing all the way to the left, regardless of whether the patient actually rotated a full 90 degrees from front. The actual value of the SHV is arbitrary, and could be "−1" and "+1," or "0" and "+1" if such ranges lead to computational simplification.

In the case of posture, it is relatively easy to assign a physical parameters to the SHV, such as the angle that the patient is turned from facing forward. However, there are other cases in which the variable is truly hidden. An example might be where the patient activates muscle groups internally, which may or may not have any external expression. In this case, if the tonus and non-tonus conditions affect the feedback differently, the two conditions could be given values of "0" and "+1," or some other arbitrary values. One of the advantage of using SHVs is that only the measurements of the vibration/motion response of the microphone assembly need to be made, there is no need to measure the actual hidden variable. That is, the hidden variable(s) can be estimated and/or deduced.

As shown in FIG. 8, the adaptive system utilizes two adaptive cancellation filters 90 and 92 instead of one fixed cancellation filter. The cancellation filters are identical and each cancellation filter 90, 92, includes an adaptive filter (not shown) for use in adjusting the motion accelerometer signal, Acc, to match the microphone output signal, Mic, and thereby generate an adjusted or filtered motion signal. Additionally, each cancellation filter includes a summation device (not shown) for use in subtracting the filtered motion signals from the microphone output signals and thereby generate cancelled signals that is an estimate of the microphone response to desired signals (e.g., ambient acoustic signals). Each adaptive cancellation filter 90, 92 estimates a latent variable 'phi', a vector variable which represents the one or more dimensions of posture or other variable operating conditions that changes in the patient, but whose value is not directly observable. The estimate of the latent variable phi is used to set the coefficients of the cancellation filters to cancel out microphone noise caused by, for example, feedback and biological noise. That is, all coefficients of the filters 90, 92 are dependent upon the latent variable phi. After cancellation, one, both or a combination of the cancelled microphone signals, essentially the acoustic signal, are passed onto the remainder of the hearing instrument signal processing.

In order to determine the value of the latent variable phi that provides the best cancellation, the coefficients of the first cancellation filter 90 are set to values based on an estimate of the latent variable phi. In contrast, the coefficients of the second cancellation filter 92, called the scout cancellation filter 92, are set to values based on the estimate of the latent viable phi plus (or minus) a predetermined value delta "δ." Alternatively, the coefficients of the first filter 90 may be set to values of the latent variable plus delta and the coefficients of the second filter may be set to values of the latent variable minus delta. In this regard, the coefficients of the second adaptive filter 92 are slightly different than the coefficients of the first filter 90. Accordingly, the energies of the first and second cancelled signals or residuals output by the first and second adaptive cancellation filters 90, 92 may be slightly different. The residuals, which are the uncancelled portion of the microphone signal out of each cancellation filter 90, 92, are compared in a comparison module 94, and the difference in the residuals are used by the Phi estimator 96 to update the estimate of phi. Accordingly, the process may be repeated until the value of phi is iteratively determined. In this regard, phi may be updated until the residual value of the first and second cancellation filters is substantially equal. At such time, either of the cancelled signals may be utilized for subsequent processing, or, the cancelled signals may be averaged together in a summation device 98 and then processed.

Adjustment of the latent variable phi based on the comparison of the residuals of the cancelled signals allows for quickly adjusting the cancellation filters to the current operating conditions of the implantable hearing instrument. To further speed this process, it may be desirable to make large adjustments (i.e., steps) of the latent value, phi. For instance, if the range of the phi is known (e.g., 0 to 1) an initial mid range estimate of phi (e.g., ½) may be utilized as a first estimate. Likewise, the step size of the adjustment of phi may be relatively large (e.g., 0.05 or 0.1) to allow for quick convergence of the filter coefficients to adequately remove noise from the microphone output signal in response to changes in the operating conditions.

Figure 9:
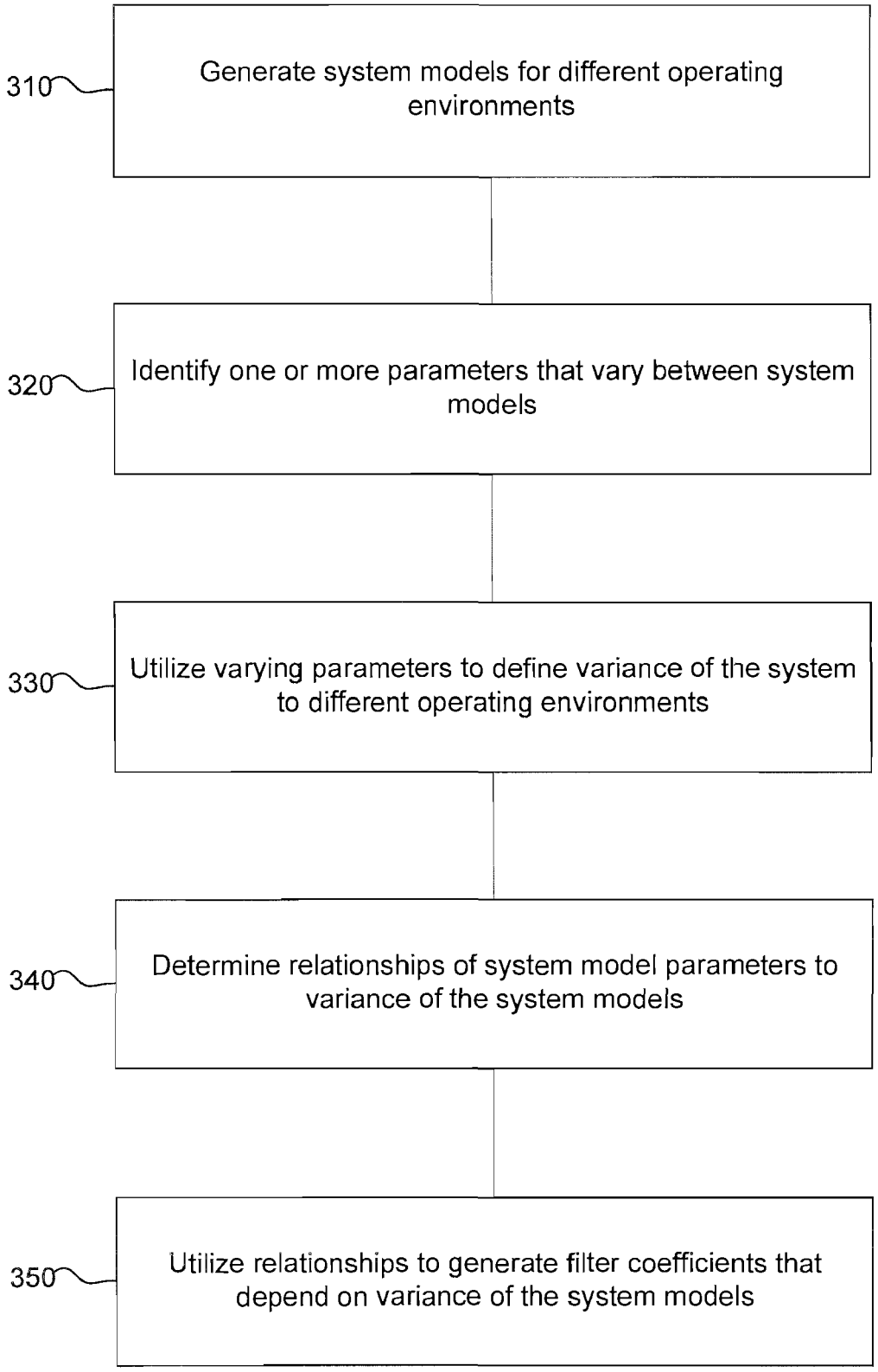
FIG. 9 is a process flow sheet.

In order to implement the system of FIG. 8, it will be appreciated that a filter must be generated where the filter coefficients are dependent upon a latent variable that is associated with variable operating conditions/environment of the implantable hearing instrument. FIGS. 9-12 provide a broad overview of how dependency of the adaptive filter on varying operating conditions is established. Following the discussion of FIGS. 9-12 is an in depth description of the generation of a latent adaptive filter. FIG. 9 illustrates an overall process 300 for generating the filter. Initially, the process requires two or more system models be generated for different operating environments. For instance, system models may be generated while a patient is looking to the left, straight ahead, to the right and/or tilted. The system models may be generated as discussed above in relation to FIGS. 4-6 or according to any appropriate methodology. Once such system models are generated 310, parameters of each of the system models may be identified 320. Specifically, parameters that vary between the different system models and hence different operating environments may be identified 320.

Figure 10:
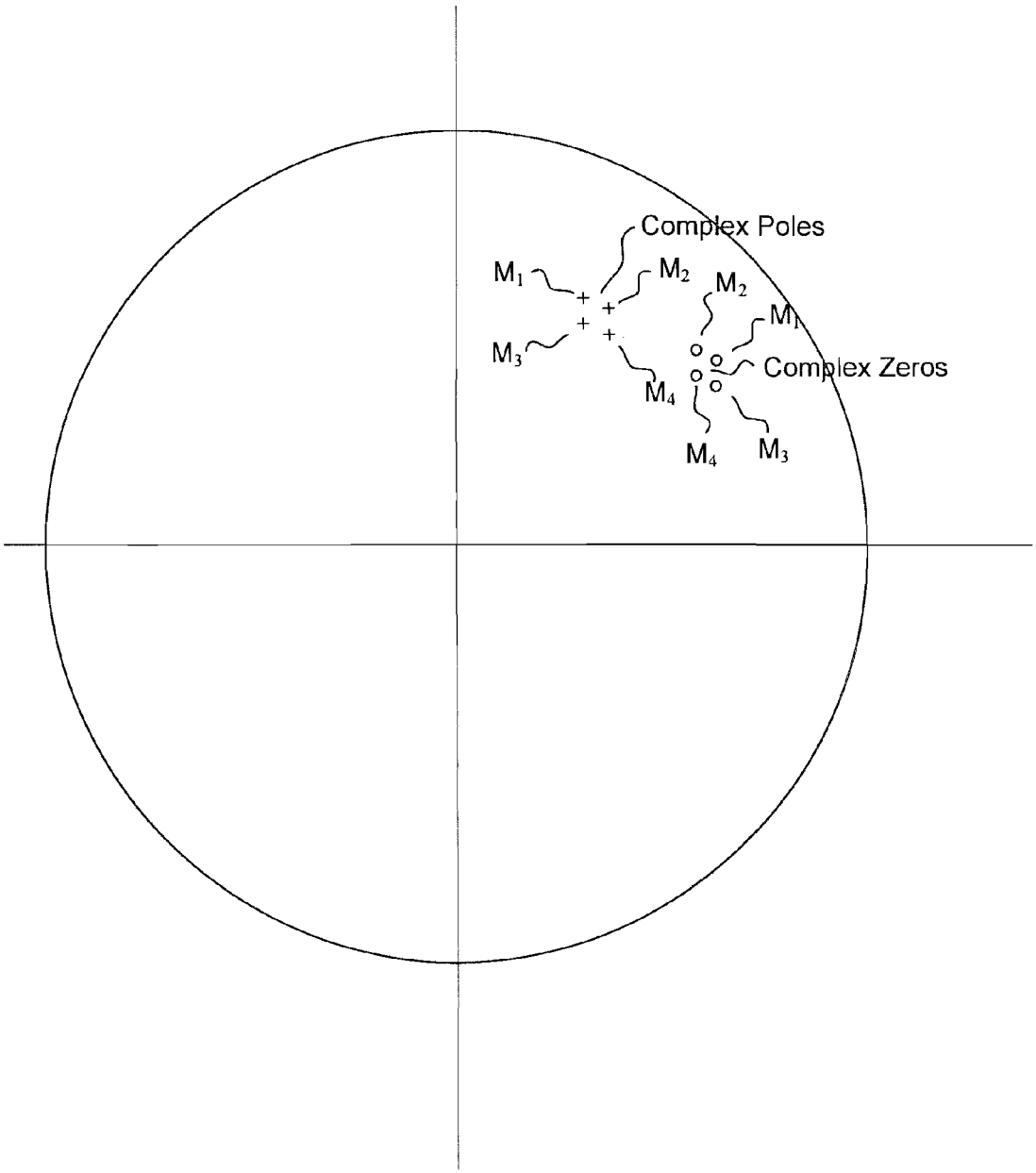
FIG. 10 illustrates a plot of operating parameters in the unit circle in the "z" dimension.
Figure 11:
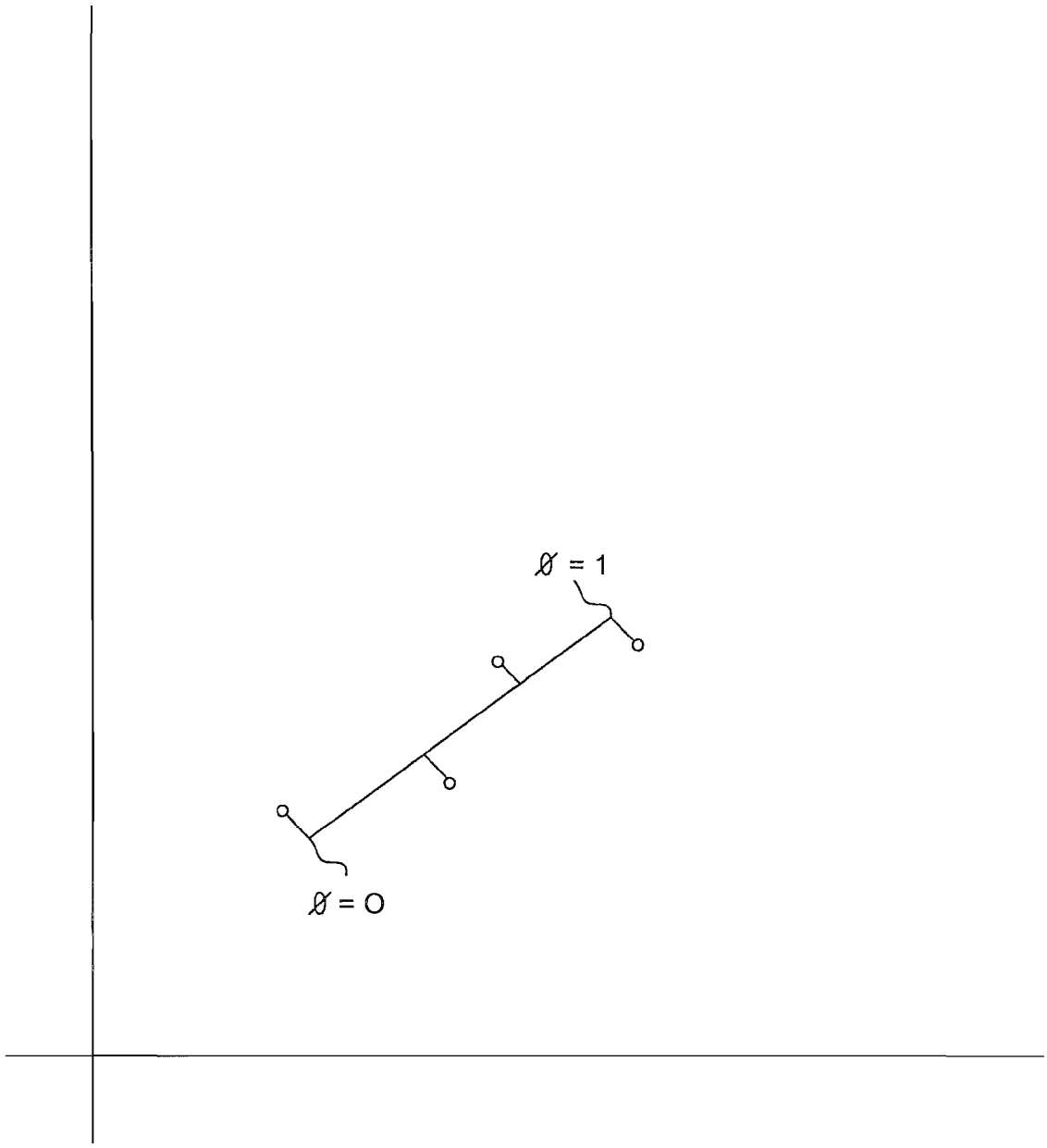
FIG. 11 illustrates fitting a line to a first set of operating parameters to define a range of a latent variable.

For instance, each system model may include multiple dimensions. Such dimensions may include, without limitation, gain, a real pole, a real zero, as well as complex poles and zeros. Further, it will be appreciated that complex poles and zeros may include a radius as well as an angular dimension. In any case, a set of these parameters that vary between different models (i.e., and different operating environments) may be identified. For instance, it may be determined that the complex radius and complex angle and gain (i.e., three parameters) of each system model show variation for different operating conditions. For instance, FIG. 10 illustrates a plot of a unit circle in a "z" dimension. As shown, the complex zeros and complex poles for four system models $M_1$-$M_4$ are projected onto the plot. As can be seen, there is some variance between the parameters of the different system models. However, it will be appreciated that other parameters may be selected. What is important is that the parameters selected vary between the system models and this variance is caused by change in the operating condition of the implantable hearing instrument.

Figure 12:
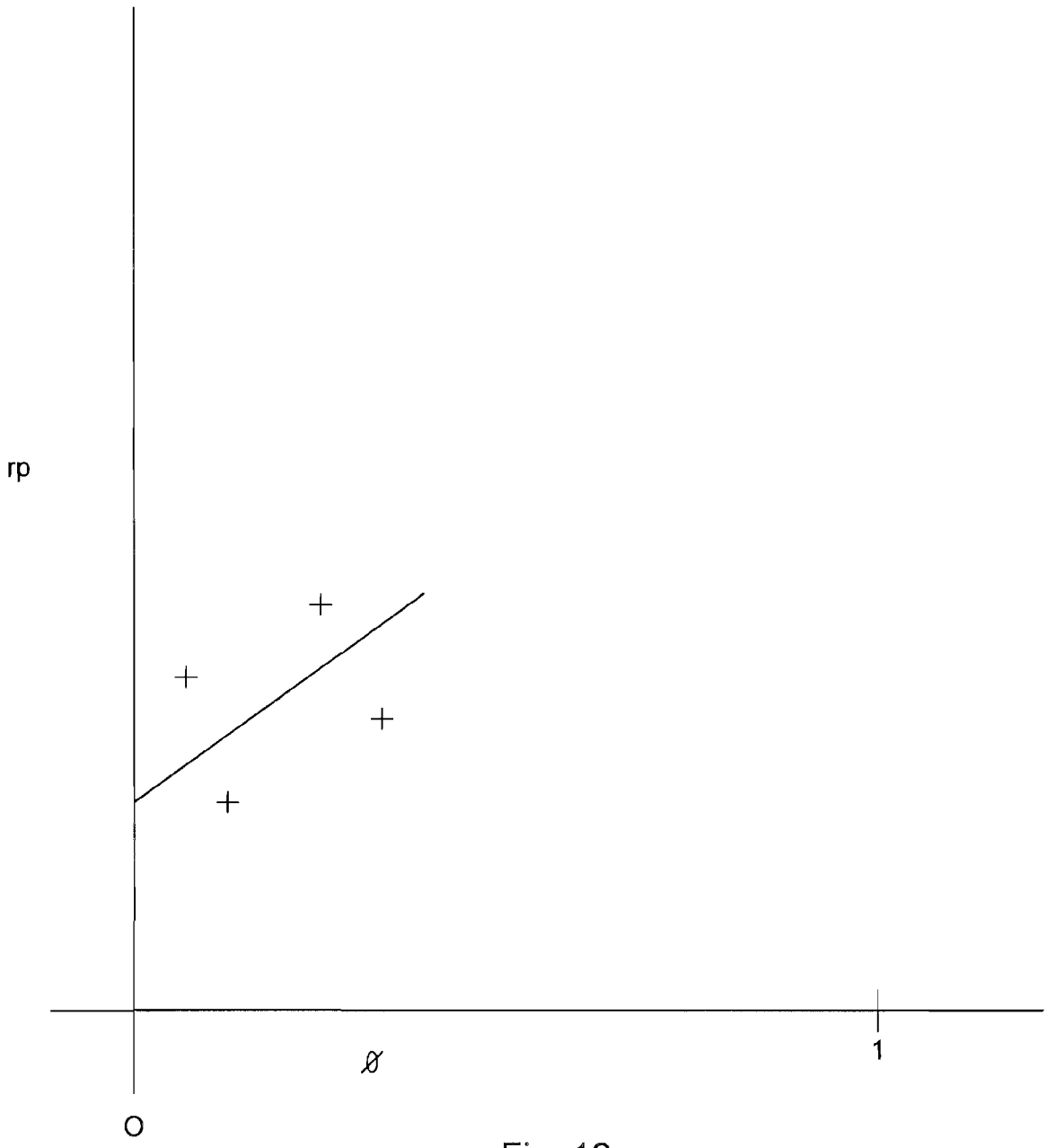
FIG. 12 illustrates a linear regression analysis of system parameters to the latent variable.

Once the variable parameters are identified 320, they may be projected 330 onto a subspace. In the present arrangement, where multiple parameters are selected, this may entail doing a principle component analysis on the selected parameters in order to reduce their dimensionality. Specifically, in the present embodiment, principle component analysis is performed to reduce dimensionality to a single dimension such that a line may be fit to the resulting data points. See FIG. 11. Accordingly, this data may represent operating environment variance or latent variable for the system. For instance, in the present arrangement where four system models are based on four different postures of the user, the variance may represent a posture value. Further, the plot may define the range of the latent variable. That is, a line fit to the data may define the limits of the latent invariable. For instance, a first end of the line may be defined as zero, and the second end of the line may be defined as one. At this point, a latent variable value for each system model may be identified. Further, the relationship of the remaining parameters of each of the system models may be determined relative to the latent variables of the system models. For instance, as shown in FIG. 12, a linear regression analysis of all the real poles of the four system models to the latent variable may be projected. In this regard, the relationship of each of the parameters (i.e., real poles, real zeros, etc.) relative to the latent variables may be determined. For instance, a slope of the resulting linear regression may be utilized as a sensitivity for each parameter. Accordingly, this relationship between the parameters and the latent variable are determined, this information may be utilized to generate a coefficient vector, where the coefficient vector may be implemented with the cancellation filters 90, 92 of the system of FIG. 8. As will be appreciated, the coefficient vector will be dependent upon the latent variable. Accordingly, by adjusting a single value (the latent variable), all of the coefficients may be adjusted. The following discussion provides an in depth description of the generation of the coefficient vector.

The notation utilized herein for the latent variable is $\phi$. While the latent variable can be a vector, for purposes of simplicity and not by way of limitation, it is represented as a scalar for the remainder of the present disclosure. In any case, one benefit of the latent or hidden variable $\phi$ is that it has much smaller dimensionality (in the case of a scalar, dim=1) than the number of coefficients in the filter (typically dim=7). As a result, adapting the latent variable $\phi$, rather than the coefficients of the filter directly, results in a much faster adaptation. Since a scalar only has one "eigenvalue," the learning matrix has only one value, which can be chosen to give the fastest possible adaptation for a given amount of acceptable variance.

The development of the SHVAF proceeds analogously to the conventional adaptive filter.

$$\phi_{k+1}=\phi_k-\mu\tilde{y}_m(\phi_k)\partial_{100}\tilde{y}_m(\phi_k) \qquad \text{Eq. 8}$$

where $\phi_k$ is the estimate of the latent variable at time sample k. Once $\phi$ is estimated, the coefficient vector $\theta$ has to be computed. The functional dependency of $\theta$ on $\phi$ could be extremely complicated. For simplicity, it may be written as a Taylor expansion:

$$\theta_{k+1}=\theta(\phi 0)+\partial_{\phi 0}\theta(\phi_{k+1}-\phi 0)+\text{HOT} \qquad \text{Eq. 9}$$

where $\phi 0$ is some nominal value of $\phi$ (ideally close to $\phi$ for all changes in the system), $\partial_{\phi 0}\,\theta$ is the change in the coefficient vector with respect to $\phi$ at the value of $\phi 0$, and HOT=higher order terms. It has been found experimentally that the poles and zeros move around only slightly with changes in posture, and the functional dependency of $\theta$ on $\phi$ is nearly linear for such small changes in the poles and zero positions, so that the HOT can be ignored. By combining terms, this can be rewritten as:

$$\theta_{k+1}=c\,\phi_{k+1}+d \qquad \text{Eq. 10}$$

where c and d are vectors. These two vector constants may be computed from two or more measurements performed on the patient. Suppose that during the fitting process the patient is measured at a posture that we call $\phi=0$, and the coefficient vector is determined using a statistically optimum approach, such as Box-Jenkins. This value may be termed $\theta(0)$. Next, coefficients for a second extreme posture $\phi=1$ are determined. This value may be called $\theta(1)$. Then the linear interpolation/extrapolation of $\theta(\phi)$ is given by:

$$\theta(\phi)=\theta(0)+(\theta(1)-\theta(0))\phi \qquad \text{Eq. 11}$$

It is easily seen that this has the same form as for $\theta_{k+}1$, therefore:

$$\theta_{k+1}=\theta(0)+(\theta(1)-\theta(0)\phi_{k+1} \qquad \text{Eq. 12}$$

where $\theta(0)$ and $\theta(1)$ depend on the two measurements (i.e., system models) and cancellation coefficient fittings done offline on data from the two postures.

Now that the coefficients of the filter are computed, the gradient $\partial_\phi\,\tilde{y}_m(\phi_k)$ must be determined. This can be a difficult and computationally intensive task, but for scalar $\phi$, a well-known approximation results from taking the derivative:

$$\partial_\phi \tilde{y}_m(\phi_k) \cong \frac{\tilde{y}_m(\phi_k+\delta)-\tilde{y}_m(\phi_k-\delta)}{2\delta} \quad \text{Eq. 13}$$

where $\delta$ is a number that is a fraction of the total range of $\phi$; if the range of $\phi$ is [0,1], a satisfactory value of $\delta$ is ⅛. Since $\delta$ is a known constant, ½$\delta$ is easily computed beforehand, so that only multiplications and no divisions need to be performed real-time. To compute $\tilde{y}_m(\phi_k+\delta)$ and $\tilde{y}_m(\phi_k-\delta)$ requires the computation of the coefficients:

$$\theta_{k+1}(+\delta)=\theta(0)+(\theta(1)-\theta(0))(\phi_{k+1}+\delta); \text{ and}$$

$$\theta_{k+1}(-\delta)=\theta(0)+(\theta(1)-\theta(0))(\phi_{k+1}-\delta) \quad \text{Eq. 14}$$

This can be simplified a little for the benefit of the real time computation by writing as:

$$\theta_{k+1}(+\delta)=(\theta(0)+(\theta(1)-\theta(0))\delta)+(\theta(1)-\theta(0))\phi_{k+1}; \text{ and}$$

$$\theta_{k+1}(-\delta)=(\theta(0)-(\theta(1)-\theta(0))\delta)+(\theta(1)-\theta(0))\phi_{k+1} \quad \text{Eq. 15}$$

This speeds up the real time calculation because $\theta(0)+(\theta(1)-\theta(0))\delta$ and $\theta(0)-(\theta(1)-\theta(0))\delta$ can be pre-computed offline, eliminating one addition and one subtraction per coefficient.

Once the coefficients $\theta_{k+1}(+\delta)$ and $\theta_{k+1}(-\delta)$ are calculated, they are applied to separate filters and cancelled against the microphone input:

$$\tilde{y}_m(\phi_k+\delta)=y_m-H(\theta_{k+1}(+\delta))y_a; \text{ and}$$

$$\tilde{y}_m(\phi_k-\delta)=y_m-H(\theta_{k+1}(-\delta))y_a \quad \text{Eq. 16}$$

where H is the filter structure being used, and $\theta_{k+1}(+\delta)$ and $\theta_{k+1}(-\delta)$ are the coefficients being used for that structure. Other implementations are possible, of course, to improve the numerical stability of the filter, or to improve the quantization errors associated with the filter, but one way of expressing the IIR filter coefficients is:

$$\theta=\{b,a\} \quad \text{Eq. 17}$$

where b and a are the (more or less) traditional direct form II IIR filter coefficient vectors.

$$H(b,a)\alpha_k=\beta_k=\sum_{j=0}^{p} b_j\alpha_{k-j}-\sum_{j=1}^{q} a_j\beta_{k-j} \quad \text{Eq. 18}$$

where p=the number of zeros, and q=the number of poles. In practice, H can be a 3/3 (3 zero, 3 pole) direct form II IIR filter. This is found to cancel the signal well, in spite of apparent differences between the mic/acc transfer function and a 3/3 filter transfer function.

A 3/3 filter also proves to be acceptably numerically stable under most circumstances. Under some conditions of very large input signals, however, the output of the filter may saturate. This nonlinear circumstance may cause the poles to shift from being stable (interior to the z domain unit circle) to being unstable (exterior to the z domain unit circle), especially if the poles were close to the unit circle to begin with. This induces what is known as overflow oscillation. When this happens on either filter, that filter may oscillate indefinitely. An approach known as overflow oscillation control can be used to prevent this by detecting the saturation, and resetting the delay line values of the filter. This allows the filter to recover from the overflow. To prevent the latent variable filter from generating incorrect values of $\phi$, $\phi$ is held constant until the filter has recovered. If only one filter overflowed, only one filter needs to be reset, but both may be reset whenever any overflow is detected. Resetting only one filter may have advantages in maintaining some cancellation during the saturation period, but normally if either filter overflowed due to a very large input signal, the other one will overflow also.

The gradient is then approximated by:

$$\partial_\phi \tilde{y}_m(\phi_k) \cong \frac{(y_m-H(\theta_{k+1}(+\delta))y_a)-(y_m-H(\theta_{k+1}(-\delta))y_a)}{2\delta} = \frac{-H(\theta_{k+1}(+\delta))y_a+H(\theta_{k+1}(-\delta))y_a}{2\delta} \quad \text{Eq. 19}$$

Of note, the gradient of the cancelled microphone signal does not depend on the microphone input $y_m$, but only on the accelerometer input $y_a$. Thus, to the extent that acoustic signals do not appear in the accelerometer input $y_a$, the latent variable filter is independent of, and will ignore, acoustic input signals during adaptation.

Of note, the two filter outputs are used not just to estimate the gradient as shown above, but are also used to compute the output of the SHVAF output. The two cancellation filters $y_m-H(\theta_{k+1}(+\delta)y_a$ and $y_m-H(\theta_{k+1}(-\delta))y_a$ are thus used to compute both the gradient and the cancelled microphone signal, so for the cost of two moderately complicated filters, two variables are computed. Accordingly the cancelled microphone output may be estimated from the average output of the two filters after cancellation with the microphone input:

$$\tilde{y}_m(\phi_k) \cong \frac{\tilde{y}_m(\phi_k+\delta)+\tilde{y}_m(\phi_k-\delta)}{2} \quad \text{Eq. 20}$$

Note that the average is symmetrical about $\phi_k$, similarly to how the derivative is computed, which reduces bias errors such as would occur if the gradient were computed from the points $\phi_k$ and $\phi_k+\delta$, and the cancellation is maximized. In practice, it is found that:

$$\frac{\tilde{y}_m(\phi_k+\delta)+\tilde{y}_m(\phi_k-\delta)}{2} \quad \text{Eq. 21}$$

can be a much better estimate of the cancelled signal than either:

$$\tilde{y}_m(\phi_k+\delta) \text{ or}$$

$$\tilde{y}_m(\phi_k+\delta). \quad \text{Eq. 22}$$

There are additional simplifications that can be made at this point. One very desirable property is that the convergence rate not depend on the amplitude of the input signals. This can be achieved by normalizing, as in the well-known NLMS algorithm, but this requires a computationally expensive division or reciprocation. A simpler way of achieving nearly the same results is by using the sign of the term $\tilde{y}_m(\theta_k)\partial_\theta \tilde{y}_m(\theta_k)$. As noted above in the section on general adaptation, this term came from $\partial_\theta \tilde{y}_m(\theta_k)^2$, so reverting to the earlier form and the approximating the differential again we have:

$$signum(\tilde{y}_m(\theta_k)\partial_\theta\tilde{y}_m(\theta_k)) \cong signum(\tilde{y}_m(\phi_k+\delta)^2-\tilde{y}_m(\phi_k-\delta)^2) \quad \text{Eq. 23}$$

The convergence rate is now independent of input amplitude. The factor of $\mu$ continues to set the rate of adaptation, but note that a different value will normally be needed here.

The latent filter algorithm is also easy to check that reasonable results are being obtained and it is stable, which leads to robust response to correlated input signals. While general IIR filters present an optimization space that is not convex and has multiple local minima, the latent filter optimization space is convex in the neighborhood of the fittings (otherwise the fittings would not have converged to these values in the first place). The function $J(\phi)$ is found to be very nearly parabolic over a broad range empirically. As a result, a single global optimum is found, regardless of the fact that the filter depends upon a number coefficients. Note that if $H(\theta(0))$ and $H(\theta(1))$ are both stable in some neighborhood $\epsilon$ about $\theta(\pm\epsilon)$ and $\theta(1+\epsilon)$, and if $\epsilon$ can be chosen large enough, then all possible values between $\theta(-\delta)$ and $\theta(1+\delta)$ will be stable; this condition can easily be checked offline. This means that any value of $\phi$ in the range $[-\delta,1+\delta]$ will be stable, and it is a simple matter to check the stability at run time by checking $\phi$ against the range limits [0,1].

In fact, this becomes a useful way of making sure the algorithm is adapting to the vibration component of the input, and not to the correlation between the input and the output signals. If the input signal has long-term correlation, the algorithm will adapt to the extent that it is able to before it hits a range limit, or until feedback begins to become audible. If feedback is present, the energy of the feedback signal will drive the latent variable filter to cancel it out. For a given range of $\phi$, representing perhaps posture, it is found that the coefficients change by only small amount. As a result, even with $\phi$ undergoing its greatest possible change in value, the actual change in cancellation is small except at the resonance. As a result, self-correlated signals tend to make relatively little impact on the cancellation process. This impact diminishes as bandwidth of the input signal increases. This is because, with a single input tone, there isn't enough information to tell if the amplitude and phase of the transfer function are due to vibration feedback, acoustic input leaking into the acceleration channel, or a combination of the two, since information is only available at one frequency. As the bandwidth increases, the number independent frequencies providing information increases as well. As a result, for a wide bandwidth input signal, there is a more-or-less unique value of $\phi$ that is determined for the vibration feedback present, with the remaining acoustic signal leaking into the accelerometer channel being averaged out as noise. Initial conditions are set by the expectation of which posture will be most commonly encountered, and minimization of the time for the filter to achieve a "good enough" optimum. For purposes of this paper, splitting the difference between the two extrema of $\phi$ will be good enough for an initial guess to start the optimization process. For instance, if the allowed range for $\phi$ is [0,−1], then a good initial guess will be $\phi=½$.

Those skilled in the art will appreciate variations of the above-described embodiments that fall within the scope of the invention. For instance, sub-band processing may be utilized to implement filtering of different outputs. As a result, the invention is not limited to the specific examples and illustrations discussed above, but only by the following claims and their equivalents.

The invention claimed is:

1. A method for use with an implantable hearing instrument, comprising:

generating a first system model of a first relationship of output signals of an implantable microphone and a motion sensor in response to a first operating environment;

generating a second system model of a second relationship of output signals of said implantable microphone and said motion sensor in response to a second operating environment, wherein said first and second operating environments are different; and using said first and second system models, generating a variable system model of relationships of output signals of said implantable microphone and said motion sensor, wherein said variable system model is at least partially dependent upon a variable operating environment of said hearing instrument.

2. The method of claim 1, wherein said variable operating environment comprises a latent parameter associated with said variable operating environment.

3. The method of claim 2, further comprising:

interactively identifying a value associated with said latent parameter.

4. The method of claim 1, further comprising:

identifying a value associated with said variable operating environment; and based on said value, utilizing said variable system model to alter at least a first characteristic of subsequent output signals of said motion sensor and generate altered output signals.

5. The method of claim 4, further comprising:

combining said altered output signals with corresponding output signals of said implantable microphone.

6. The method of claim 5, wherein combining comprises subtracting said altered output signals from said corresponding output signals of said implantable microphone.

7. The method of claim 1, wherein generating said first and second system models comprises generating first and second mathematical functions approximating said first and second relationships, respectively.

8. The method of claim 7, wherein generating said variable system model comprises:

identifying two or more parameters associated with each of said first and second mathematical functions that vary based on said first and second operating environments; and reducing a dimensionality of said parameters to define a range of variance associated with said first and second operating environments.

9. The method of claim 8, further comprising:

identifying dependency relationships between corresponding parameters of said functions and said range of variance; and utilizing said dependency relationships to generate filter coefficients for said variable system model, wherein each said filter coefficient is dependent upon said range of variance.

10. The method of claim 1, wherein generating first and second system models in response to said first and second operating environments comprises generating said first and second systems models in response to first and second different postures of a user of said implantable hearing instrument.

11. The method of claim 1, further comprising:

generating a plurality of system models associated with a plurality of operating conditions; and using said plurality of system models to generate said variable system model.

12. A method for use with an implantable hearing instrument, comprising:

generating a plurality of system models defining relationships of corresponding outputs of an implantable microphone and a motion sensor, wherein said plurality of system models are associated with a corresponding plurality of different operating environments for said hearing instrument;

identifying at least one parameter of said system models that varies between different system models;

fitting a function to a set of values corresponding to said at least one parameter that varies between different system models, wherein said function defines a range of variance for said plurality of operating environments;

utilizing said function and said system models to generate a variable system model that is dependent on an operating environment variable associated with said range of variance.

13. The method of claim 12, wherein said different operating environments each comprise a different posture of a user of the hearing instrument.

14. The method of claim 13, wherein said operating environment variable comprises a posture dependent variable.

15. The method of claim 12, wherein identifying comprises identifying at least two parameters for each said system model, wherein said at least two parameters vary between system models.

16. The method of claim 15, wherein fitting a function comprises:

performing a principal component reduction on values associated with said at least two parameters.

17. The method of claim 12, wherein utilizing said function further comprises:

identifying relationships of said system models to said function; and utilizing said relationships to generate filter coefficients for said variable system model, wherein said filter coefficients are dependent on said operating environment variable.

18. The method of claim 17, further comprising:

generating an estimated value of said operating environment variable;

based on said estimated value, utilizing said variable system model to adjust at least a portion of an output of a motion sensor to generate an adjusted output; and removing said adjusted output from an output of an implantable microphone.

19. The method of claim 18, further comprising:

iteratively adjusting said estimated value to minimize a residual associated with the removing of said adjusted output from said output of said implantable microphone.

* * * * *